US010903064B2

(12) United States Patent
Chen

(10) Patent No.: US 10,903,064 B2
(45) Date of Patent: Jan. 26, 2021

(54) METHODS FOR DETECTION OF ION SPATIAL DISTRIBUTION

(71) Applicant: Thermo Finnigan LLC, San Jose, CA (US)

(72) Inventor: Tsung-Chi Chen, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 16/683,911

(22) Filed: Nov. 14, 2019

(65) Prior Publication Data

US 2020/0083035 A1 Mar. 12, 2020

Related U.S. Application Data

(62) Division of application No. 16/038,546, filed on Jul. 18, 2018, now Pat. No. 10,490,397.

(51) Int. Cl.

| | |
|---|---|
| ***H01J 49/42*** | (2006.01) |
| ***H01J 49/00*** | (2006.01) |
| ***H01J 49/02*** | (2006.01) |

(52) U.S. Cl.

CPC ..... *H01J 49/4215* (2013.01); *H01J 49/0031* (2013.01); *H01J 49/0036* (2013.01); *H01J 49/025* (2013.01)

(58) Field of Classification Search

None

See application file for complete search history.

(56) References Cited

U.S. PATENT DOCUMENTS

| | | | | |
|---|---|---|---|---|
| 3,917,950 | A * | 11/1975 | Carlson | G01N 23/043 250/483.1 |
| 7,141,785 | B2 | 11/2006 | Bateman et al. | |
| 8,389,929 | B2 * | 3/2013 | Schoen | H01J 49/42 250/281 |
| 8,884,220 | B2 | 11/2014 | Hoyes et al. | |

(Continued)

FOREIGN PATENT DOCUMENTS

JP 2009-517841 A 4/2009

OTHER PUBLICATIONS

Gys, "Micro-channel plates and vacuum detectors", Nuclear Instruments and Methods in Physics Research A 787 (2015), pp. 254-260.

(Continued)

*Primary Examiner* — Andrew Smyth

(74) *Attorney, Agent, or Firm* — Thomas F. Cooney

(57) ABSTRACT

A method of performing mass spectrometric analyses, comprises: (a) passing a stream of ions through a quadrupole mass analyzer; (b) intercepting a flux of ions emitted from an exit aperture of the quadrupole mass analyzer at a front face of a stack of multichannel plates and emitting a flux of electrons in response to the intercepted flux of ions at a rear face of the stack of multichannel plates; (c) intercepting the flux of electrons at a front surface of a scintillator comprising a phosphorescent material and emitting a flux of photons in response to the intercepted flux of ions at a rear surface of the scintillator; (d) receiving the flux of photons at a photo-imager; and (e) repositioning at least one of the scintillator and the stack of microchannel plates during the execution of one or more of the steps (a) through (d).

11 Claims, 13 Drawing Sheets

(56) References Cited

U.S. PATENT DOCUMENTS

| | | | | |
|---|---|---|---|---|
| 8,890,086 | B1 | 11/2014 | Goldberg et al. | |
| 9,355,828 | B1 * | 5/2016 | Smith | H01J 49/0031 |
| 2002/0020817 | A1 * | 2/2002 | Feller | H01J 49/025 250/397 |
| 2009/0208398 | A1 * | 8/2009 | Li | B82Y 30/00 423/263 |
| 2011/0095177 | A1 | 4/2011 | Giannakopulos et al. | |
| 2011/0095178 | A1 | 4/2011 | Giannakopulos et al. | |
| 2011/0176657 | A1 * | 7/2011 | Okuda | G01T 1/202 378/21 |
| 2011/0186746 | A1 * | 8/2011 | Drees | A61N 5/10 250/397 |
| 2013/0087739 | A1 * | 4/2013 | Kano | C09K 11/623 252/301.6 R |
| 2013/0264474 | A1 | 10/2013 | Kholomeev et al. | |
| 2014/0374592 | A1 * | 12/2014 | Baba | H01J 49/4255 250/283 |
| 2016/0056347 | A1 * | 2/2016 | Kubat | |

OTHER PUBLICATIONS

Nikl et al., "50. Single-Crystal Scintillation Materials", Springer Handbook of Crystal Growth (2010), Part H: Special Topics in Crystal Growth, pp. 1663-1700.

Park et al., "Performance comparison between ceramic Ce:GAGG and single crystal Ce:GAGG with digital-Si PM", Journal of Instrumentation, 2017, 12 (1), P01002.

Tous et al., "Single crystal scintillator plates used for lightweight material X-ray radiography", Journal of Physics: Conference Series 425 (2013), 192017.

Yanagida et al., "Comparative study of ceramic and single crystal Ce:GAGG scintillator", Optical Materials 35 (2013), pp. 2480-2485.

Dass, "Mass Analysis and Ion Detection", in "Fundamentals of Contemporary Mass Spectrometry", Wiley-Interscience, 2007, Chapter 3, pp. 67-117.

Dubois et al., "A comparison between ion-to-photon and rnicrochannel plate detectors", Rapid Communications in Mass Spectrometry (1999), vol. 13 (9), pp. 786-791.

Gilmore et al., "Ion detection efficiency in SIMS: dependencies on energy, mass and composition for microchannel plates used in mass spectrometry", International Journal of Mass Spectrometry 202 (2000), pp. 217-229.

Okumura et al., "Time-of-flight system with a movable ion detector for absolute measurement of cyclotron beam energy", Review of Scientific Instruments (2005), vol. 76 (11), p. 113106.

Silivra et al., "Characterization of MCP/Scintillator Sandwich by Use of High Speed Multichannel Photon Sensors for Purposes of Ion Detection", Poster, 66th Conference on Mass Spectrometry and Allied Topics, San Diego, 2018, https://assets.thermofisher.com/TFS-Assets/CMD/posters/po-65300-ms-mcp-scintillator-sandwich-ion-detection-asms2018-po65300-en.pdf.

* cited by examiner

FIG. 8A
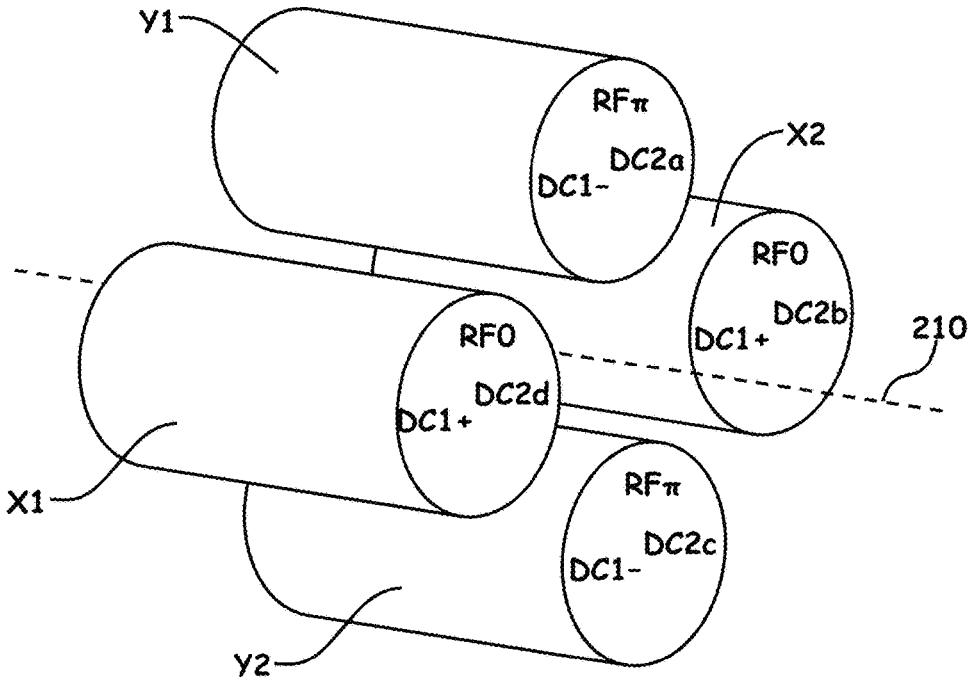
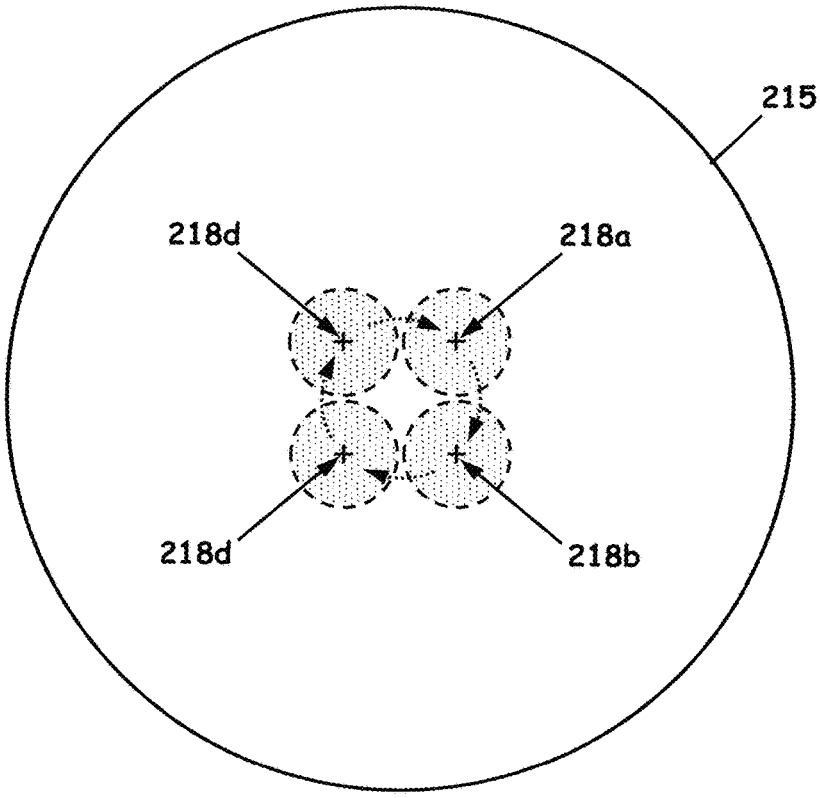
FIG. 8B

METHODS FOR DETECTION OF ION SPATIAL DISTRIBUTION

CROSS REFERENCE TO RELATED APPLICATION

This application is a Divisional of and claims, under 35 U.S.C. 120, the right of priority to and the benefit of the filing date of U.S. patent application Ser. No. 16/038,546, now U.S. Pat. No. 10,490,397, filed on Jul. 18, 2018, the disclosure of which is incorporated by reference herein in its entirety.

FIELD OF THE INVENTION

The present invention relates to the field of mass spectrometry. More particularly, the present invention relates to mass spectrometer detector systems and methods in which ions exiting a quadrupole mass analyzer are converted to a quantity of electrons and said electrons are converted to a quantity of photons that are focused onto an image plane and imaged by a photo-imager.

BACKGROUND OF THE INVENTION

Quadrupole mass filters are often employed as a component of a triple stage mass spectrometry system. By way of non-limiting example, FIG. 1A schematically illustrates a triple-quadrupole system, as generally designated by the reference numeral 1. The operation of mass spectrometer 1 can be controlled and data 68 can be acquired by a control and data system (not depicted) of various circuitry of one or more known types, which may be implemented as any one or a combination of general or special-purpose processors (e.g. a field-programmable gate array (FPGA), firmware, software to provide instrument control and data analysis for mass spectrometers and/or related instruments. A sample containing one or more analytes of interest can be ionized via an ion source 52 operating at or near atmospheric or sub-ambient pressure. The resultant ions are directed via predetermined ion optics that often can include tube lenses, skimmers, ion funnels 51, and multipoles (e.g., reference characters 53 and 54) so as to be urged through a series of chambers, e.g., chambers 2, 3 and 4, of progressively reduced pressure that operationally guide and focus such ions to provide good transmission efficiencies. The various chambers communicate with corresponding ports 80 (represented as arrows in FIG. 1A) that are coupled to a set of vacuum pumps (differential pumping, not shown) to maintain the pressures at the desired values.

The example mass spectrometer system 1 of FIG. 1A is shown illustrated to include a triple stage configuration 64 within a high vacuum chamber 5, the triple stage configuration having sections labeled Q1, Q2 and Q3 electrically coupled to respective power supplies (not shown). The Q1, Q2 and Q3 stages may be operated, respectively, as a first quadrupole mass filter, a fragmentation cell, and a second quadrupole mass filter. Ions are analyzed or filtered at the first stage, fragmented at the second stage, and/or analyzed or filtered within the last stage, and are then passed to a detector 66. Such a detector is beneficially placed at the channel exit of the quadrupole (e.g., Q3 of FIG. 1A) to provide ion abundance information that can be processed into a rich mass spectrum (data) 68 showing the variation of ion abundance with respect to m/z ratio. With the recent development of imaging ion detectors for detecting ions emerging from a quadrupole mass filter (see detailed discussion below), three-dimensional information (e.g., two spatial dimensions and one temporal dimension) may be obtained which maintains high mass resolving power without significant degradation of signal intensity.

During conventional operation of a multipole mass filter, such as the quadrupole mass filter Q3 shown in FIG. 1A, to generate a mass spectrum, a detector (e.g., the detector 66 of FIG. 1A) is used to measure the quantity of ions that pass completely through the mass filter as a function of time during the application of superimposed oscillatory radio frequency (RF) and non-oscillatory (DC) electric fields. Thus, at any point in time, the detector only receives those ions having m/z ratios within the mass filter pass band at that time—that is, only those ions having stable trajectories within the multipole under the particular RF and DC voltages that are applied to the quadrupole at that time. Such conventional operation creates a trade-off between instrument resolution and sensitivity. High mass resolving can be achieved, but only if the DC/RF ratio is such that the filter pass band is very narrow, such that most ions develop unstable trajectories within the mass filter and few pass through to the detector. Under such conditions, scans must be performed relatively slowly so as to detect an adequate number of ions at each m/z data point. Conversely, high sensitivity or high speed can also be achieved during conventional operation, but only by widening the pass band, thus causing degradation of m/z resolution.

U.S. Pat. No. 8,389,929, which is assigned to the assignee of the present invention and which is incorporated by reference herein in its entirety, teaches a quadrupole mass filter method and system that discriminates among ion species, even when both are simultaneously stable, by recording where the ions strike a position-sensitive detector as a function of the applied RF and DC fields. When the arrival times and positions are recorded, the resulting data can be thought of as a series of ion images. Each observed ion image is essentially the superposition of component images, one for each distinct m/z value exiting the quadrupole at a given time instant. The same patent also teaches methods for the prediction of an arbitrary ion image as a function of m/z and the applied field. Thus, each individual component image can be extracted from a sequence of observed ion images by mathematical deconvolution or decomposition processes, as further discussed in the aforementioned patent. The mass-to-charge ratio and abundance of each species necessarily follow directly from the deconvolution or decomposition. Accordingly, high mass resolving power can be achieved under a wide variety of operating conditions, a property not usually associated with quadrupole mass spectrometers.

The inventors of U.S. Pat. No. 8,389,929 recognized that ions of different m/z ratios exiting a quadrupole mass filter may be discriminated, even when both ions are simultaneously stable (that is, have stable trajectories) within the mass filter by recording where the ions strike a position-sensitive detector as a function of the applied RF and DC fields. The inventors of U.S. Pat. No. 8,389,929 recognized that such operation is advantageous because when a quadrupole is operated in, for example, a mass filter mode, the scanning of the device that is provided by ramped RF and DC voltages naturally varies the spatial characteristics with time as observed at the exit aperture of the quadrupole. Specifically, ions manipulated by a quadrupole are induced to perform a complex 2-dimensional oscillatory motion on the detector cross section as the scan passes through the stability region of the ions. All ion species of respective m/z ratios express exactly the same motion, across the same range of Mathieu parameter "a" and "q" values (see FIG. 13), but at different respective RF and DC voltages and at different respective times. The ion motion (i.e., for a cloud of ions of the same m/z but with various initial displacements and velocities) may be characterized by the variation of a and q, this variation influencing the position and shape cloud of ions exiting the quadrupole as a function of time. For two masses that are almost identical, the sequence of their respective oscillatory motions is essentially the same and can be approximately related by a time shift.

The teachings of the aforementioned U.S. Pat. No. 8,389,929 exploit the varying spatial characteristics by collecting the spatially dispersed ions of different m/z even as they exit the quadrupole at essentially the same time. FIG. 1B shows a simulated recorded image of a particular pattern at a particular instant in time. The example image can be collected by a fast detector, (i.e., a detector capable of fast sampling within 10 or more RF cycles, more often down to an RF cycle or with sub RF cycles specificity, where said sub-RF specificity is possibly averaged for multiple RF cycles), positioned to acquire where and when ions exit to distinguish fine detail. The motion of ions may be referenced to a conventional Mathieu diagram (FIG. 13). During a mass scan, the (q, a) position of any ion is described by motion along scan line 411. During a scan, the (q, a) position of an ion first approaches (point 413), then enters (point 412), then traverses across (point 415) and finally exits (point 414) the "X & Y stable" portion of the Mathieu diagram. During this time, the y-component of the ion's trajectory changes from "unstable" to "marginally stable" at the instability boundary (point 412) and then becomes increasingly "stable" thereafter (points 415, 414 and 416). Simultaneously, the x-component of the ion's trajectory qualitatively changes in the reverse sense. Watching an ion image formed in the exit cross section progress in time, the ion cloud is elongated and undergoes wild oscillations along the y-axis (herein termed "vertical" oscillations) that carry it beyond the top and bottom of a collected image. Gradually, the exit cloud contracts, and the amplitude of the y-component oscillations decreases when the (q, a) scan line is in the stable region of the ions of interest. If the cloud is sufficiently compact upon entering the quadrupole, the entire cloud remains in the image, i.e. 100% transmission efficiency, during the complete oscillation cycle when the ion is well within the stability region.

FIG. 1B graphically illustrates such a result. In particular, the vertical cloud of ions, as enclosed graphically by the ellipse 6 shown in FIG. 1B, correspond to the heavier ions entering the stability field of the quadrupole and accordingly oscillate with an amplitude that brings such heavy ions close to the denoted y-quadrupoles. The cluster of ions enclosed graphically by the ellipse 8 shown in FIG. 1B correspond to lighter ions exiting the stability field of the quadrupole and thus cause such ions to oscillate with an amplitude that brings such lighter ions close to the denoted x-quadrupoles. Within the image lie the additional clusters of ions (shown in FIG. 1B but not specifically highlighted) that have been collected at the same time frame but which have a different exit pattern because of the differences of their Mathieu a and q parameters.

FIG. 1C illustrates one example of an imaging ion detector system, generally designated by the reference numeral 20 as described in the aforementioned U.S. Pat. No. 8,389,929. As shown in FIG. 1C, incoming ions I (shown directionally by way of accompanying arrows) having for example a beam cross section of about 1 mm or less, varying to the quadrupole's inscribed radius as they exit from an ion occupation volume between quadrupole rod electrodes 101, are received by an assembly 102 of microchannel plates (MCPs) 13*a*, 13*b*. Such an assembly can include a pair of MCPs (a Chevron or V-stack) or triple (Z-stack) comprising MCPs adjacent to one another with each individual plate having sufficient gain and resolution to enable operating at appropriate bandwidth requirements (e.g., at about 1 MHz up to about 100 MHz) with the combination of plates generating up to about $10^7$ electrons in response to each incident ion.

To illustrate operability by way of an example, the first surface of the MCP assembly 102 can be floated to 10 kV, (i.e., +10 kV when configured for negative ions and −10 kV when configured to receive positive ions), with the second surface floated to +12 kV and −8 kV respectively, as shown in FIG. 1C. Such a plate biasing provides for a 2 kV voltage gradient to provide the gain with a resultant output relative 8 to 12 kV relative to ground. All high voltages portions are under vacuum between about $10^{-5}$ mBar ($10^{-3}$ Pa) and $10^{-6}$ mBar ($10^{-4}$ Pa).

The example biasing arrangement of FIG. 1C thus enables impinging ions I as received from, for example, the exit of a quadrupole, as discussed above, to induce electrons in the front surface of the first MCP 13*a* for the case of positive ions, that are thereafter directed to travel along individual channels of the first MCP 13*a* as accelerated by the applied voltages. As known to those skilled in the art, since each channel of the MCP serves as an independent electron multiplier, the input ions I as received on the channel walls produce emission of secondary electrons (denoted as $e^-$). These electrons are then accelerated by the potential gradient across the ends of each individual MCP 13*a*, 13*b* of the MCP stack 102 and strike inner surfaces of the channel causing more emission of electrons that are released from the output end of the MCP stack 102. This process substantially enables the preservation of the pattern (image) of the particles incident on the front surface of the MCP. When operated in negative ion mode, negative ions are initially converted to small positive ions that then induce a similar electron cascade as is well known in the art.

The biasing arrangement of the detector system 20 (FIG. 1C) also provides for the electrons multiplied by the MCP stack 102 to be further accelerated in order to strike an optical component, e.g., a phosphor coated fiber optic plate 15 configured behind the MCP stack 102. Such an arrangement converts the signal electrons to a plurality of resultant photons (denoted as p) that are proportional to the amount of received electrons. Alternatively, an optical component, such as, for example, an aluminized phosphor screen can be provided with a biasing arrangement (not shown) such that the resultant electron cloud from the MCP stack 102 can be drawn across a gap by the high voltage onto a phosphor screen where the kinetic energy of the electrons is released as light. The initial assembly is configured with the goal of converting either a positive or negative ion image emanating from the quadrupole exit into a photon image suitable for acquisition by subsequent photon imaging technology.

The photons p emitted by the phosphor coated fiber optic plate or aluminized phosphor screen 15 are captured and then converted to electrons which are then translated into a digital signal by a two-dimensional camera component 25 (FIG. 1C). In the illustrated arrangement, a plate, such as, a photosensitive channel plate 10 assembly (shown with the anode output biased relative to ground) can convert each incoming photon p back into a photoelectron. Each photoelectron generates a cloud of secondary electrons 11 (indicated as $e^-$) at the back of the photosensitive channel plate 10, which spreads and impacts as one arrangement, an array of detection anodes 12, such as, but not limited to, an two-dimensional array of resistive structures, a two-dimensional delay line wedge and strip design, as well as a commercial or custom delay-line anode readout. As part of the design, the photosensitive channel plate 10 and the anodes 12 are in a sealed vacuum enclosure (not shown).

Each of the anodes of the two-dimensional camera 25 shown in FIG. 1C can be coupled to an independent amplifier 14 and additional analog to digital converter (ADC) 18 as known in the art. For example, such independent amplification can be by way of differential transimpedance amplifiers or avalanche photodiodes (APD) to improve the signal-to-noise ratio and transform detected current into voltage. The signals resultant from amplifiers 14 and ADC 18 and/or charge integrators (not shown) can eventually be directed to a Field Programmable Gate Array (FPGA) 22 via, for example, a serial LVDS (low-voltage differential signaling) high-speed digital interface 21, which is a component designed for low power consumption and high noise immunity for the anticipated data rates. The FPGA 21, when electrically coupled to a computer or other data processing means 26, may be operated as an application-specific hardware accelerator for the required computationally intensive tasks.

FIG. 2 schematically depicts another example of an imaging ion detection system as described in U.S. Pat. No. 9,355,828, which is incorporated herein by reference in its entirety. The imaging ion detection system is shown generally in FIG. 2 as detector system 100. The ions I exiting from an ion occupation region between quadrupole rod electrodes 101 are converted to electrons and the electron current is amplified by microchannel plate assembly or stack 102 comprising one or a plurality of microchannel plates as previously described with reference to FIG. 1C. It is preferable to generate photons, within the system 100, using a substrate plate 109 comprising a single-piece or integral component (such as a plate of glass, mica or plastic) that is coated with a transparent material, such as indium tin oxide, comprising a biasing electrode 106 and further coated with a phosphor material comprising a phosphorescent screen 107. A phosphor-coated plate comprising a bundle of fibers (such as plate 15 employed in the system 20 illustrated in FIG. 1C) may alternatively be employed as the substrate plate 109. Voltages $V_1$ and $V_2$ are applied to electrodes at opposite ends of the MCP stack 102 so as to draw ions I onto the stack and to accelerate generated electrons (denoted as e) through the stack. A voltage $V_3$ is applied to the transparent electrode 106 to draw the electrons onto the phosphorescent screen 107 at which photons (denoted as p) are generated.

The set of components 27 shown on the right hand side of the substrate plate 109 in FIG. 2 serve to replace the two-dimensional camera 25 that is depicted in FIG. 1C. The replacement components comprise two separate linear (one-dimensional or "1-D") photo-detector arrays 132*a*, 132*b* and associated optics. In operation, the phosphorescent screen 107 radiantly "glows" with a spatially-non-uniform intensity as it is impacted by electrons $e^-$ that are generated as a result of impingement of ions I onto the microchannel plate assembly or stack 102. The pattern of this spatially-non-uniform glow at any time corresponds to the spatial distribution of the number of ions emitted from between the quadrupole rods 101 at such time. Lens 112 and cylindrical lens 121*a* serve to transfer an image of the glowing phosphorescent screen onto a first linear photo-detector array (PDA) 132*a*. Likewise, lens 112 and cylindrical lens 121*b* serve to transfer a duplicate image of the glowing phosphorescent screen onto a second linear photo-detector array array 132*b*. An axis of cylindrical lens 121*b* is oriented substantially perpendicular to an axis of cylindrical lens 121*a*. Similarly, the individual light sensitive elements of photo-detector array 132*b* are aligned along a line that is substantially perpendicular to a second line along which the individual light sensitive elements of linear photo-detector array 132*a* are aligned. The illustrated difference in shape between the first and second cylindrical lenses 121*a*, 121*b* is employed so as to indicate that the second cylindrical lens comprises an orientation that is rotated o that its axis is orthogonal to the first cylindrical lens.

Light comprising photons that are generated by the phosphorescent screen 107 and that pass through the substrate plate 109 is collected and partially collimated into a light beam by a light collection lens 112. The partially collimated light beam is then split into two light-beam portions along two respective pathways by a beam splitter 116. A first such pathway—traversed by a first light beam portion—is indicated in FIG. 2 by arrows 117 and a second such pathway—traversed by the second light beam portion—is indicated by arrows 118. These light beam portions thus transfer two copies of the image information. Each of these light beam portions may then comprise about half the intensity of the original light source. Alternatively, the beam splitter 116 may be configured such that the ratio between the intensities of the transmitted and reflected light beam portions is other than one-to-one (1:1), such as, for example, nine-to-one (9:1), four-to-one (4:1), one-to-four (1:4), one-to-nine (1:9), etc. Such beam splitters are commercially available as either off-the-shelf stock items or can be custom fabricated in almost any desired transmitted-to-reflected ratio. A beam splitter in which the transmitted-to-reflected ratio is other than 1:1 may be employed, for example, to deliver a greater proportion of the light beam intensity to a detector having less sensitivity or to deliver a lesser proportion to a detector which might be easily saturated.

Each of the two light beam portions is focused by a respective one of the cylindrical lenses 121*a*, 121*b* so as to project a respective one-dimensional image of the phosphor screen onto a onto a respective one of the linear photo-detector arrays 132*a*, 132*b*. Optionally, a reflecting device 123 comprising, such as a flat mirror or a prism, may be employed within one of the beam pathways to cause both beams to be parallel. The deflection of one of the beams by the reflecting device 123 may be used to decrease the size of the system 100 or possibly to facilitate mechanical mounting of the two linear photo-detector arrays 132*a*, 132*b* to a common circuit board and drive electronics.

According to the configuration illustrated in FIG. 2, the light beam portion that traverses the pathway indicated by arrow 117 is compressed within the x-dimension (see Cartesian axes on left side of FIG. 2) so as to be focused to a line (i.e., a line parallel to the y-dimension, perpendicular to the plane of the drawing of FIG. 2) that is coincident with the position of the first linear photo-detector array 132*a*. Similarly, the light beam portion that traverses the pathway indicated by arrow 118 is compressed within the y-dimension so as to be focused to a line that is parallel to the x-dimension and that is coincident with the position of the second linear photo-detector array 132*b*. The light-sensitive regions of the linear photo-detector arrays 132*a*, 132*b* are disposed at the foci of the cylindrical lenses 121*a*, 121*b* such that each of the light beam portions is focused to a line on the light sensitive region of the respective linear photo-detector array 132*a*, 132*b*. The first and second linear photo-detector arrays 132*a*, 132*b* may comprise, without limitation, two line cameras. The first and second linear photo-detector arrays 132*a*, 132*b* may be substantially identical to one another. However, the first and second linear photo-detector arrays 132*a*, 132*b* are depicted differently in FIG. 2 to indicate that the orientation of the second linear photo-detector array 132*b* is rotated so as to be orthogonal to the first linear photo-detector array 132*b*.

FIG. 3 is a schematic depiction of light receiving face of a general linear photo-detector array 132. The array comprises a plurality of individual, independent light-sensitive elements 133, which may be referred to as "pixels". In the system 100 illustrated in FIG. 2 (as well as in other system embodiments taught herein), an instance of the array 132 may be optically interfaced to either a cylindrical lens 120*a*, 120*b* or a line-focusing composite lens with the linearly disposed plurality of pixels oriented so as to be coincident with a line focus produced by the cylindrical lens or composite lens.

As illustrated in FIG. 2, each linear photo-detector array retains image variation along the dimension parallel to the array and sums (or "bins") image information orthogonal to the array. Because two mutually orthogonal arrays are employed, image variation parallel to both the x-direction and the y-direction (as defined above for quadrupole apparatuses) is retained. Binning the information is a very useful method of data compression without losing much information. The system configuration depicted in FIG. 2 employs optics to enable the use of two separate, simpler, photo-detector arrays, such as line cameras, to provide the same orthogonal information as the previously-described two-dimensional camera 25 (FIG. 1C).

FIG. 4A is a simplified depiction of a portion of a known time and position imaging ion detector system for a mass spectrometer. As noted above, a stream or flux of ions I that are emitted from an exit aperture 108 of a quadrupole 101 comprising four parallel rods are intercepted by a stack 102 of microchannel plates 13*a*, 13*b*. In response to the impingement of the ions, a stream or flux of electrons $e^-$ are ejected from the MCP stack. The stream or flux of electrons retains spatial information pertaining to the original flux density of intercepted ions at each position on the MCP stack. These electrons are intercepted by a scintillator substrate plate 109 that is coated with a phosphorescent material 107. Conventionally, the phosphorescent material is a sintered powder of e.g. Ce:YAG (cerium-doped yttrium-aluminum garnet). The ions I are urged towards the MCP stack from the quadrupole 101 under the influence of biasing voltage $V_1$ provided by high-voltage supply 31. Ejected electrons are propelled from the first MCP 13*a* to the second MCP 13*b* and then to the scintillator plate 109 under the influence of biasing voltages $V_2$ and $V_3$, the latter of which may be supplied to a thin-film electrode coating 104 on the scintillator. The applied voltages, $V_1$ and $V_2$ provide for a 2 kV voltage gradient to provide the gain between the plates. All high voltages portions are under vacuum. An electronic controller 33, which may be a programmed computer or other integrated circuitry that is programmed by firmware, controls the application of voltages to the MCP and electrode 104 and also controls the application of radio frequency (RF) and other voltages to the rod electrodes of quadrupole 101.

The first two components of the detection system (the MCP and the scintillator material) often age unevenly in a short period of time as a result of being impacted by highly intense ion beams that can be focused at specific spots on the MCP and scintillator surfaces within one or more quadrupole 101 RF cycles under vacuum (e.g., $10^{-5}$ to $10^{-6}$ torr). For example, FIG. 4B shows a time series of ion images of monoisotopic polytyrosine-1 that was captured by a detector system having the components that are illustrated in FIG. 4A. The abscissa in FIG. 4B represents time and the ordinate represents displacement of images along both the y-axis (profile 202 along the top portion of the graph) and along the x-axis (profile 204 along the bottom portion). The signal intensity is represented by the darkness of the shading. The apparent asymmetric ion trajectories observed in the y-dimension at location 205 are due, in part, to the uneven gain distribution of the detection area. The uneven gain across portions of the MCP and/or phosphor surfaces as a result of rapid ion aging imposes an asymmetric wave profile in the time series of images along the y-dimension, as indicated by envelope 209 in FIG. 4C.

In reality, high gains/potentials on both the MCP and the phosphor are often required in order to achieve the detection of single ion event that is a standard requirement for a commercial quadrupole mass spectrometer instrument. The most severe aging is found to occur at positions on the MCP and scintillator at which the beam focuses. Longevity studies on the MCP and phosphor indicate that significant gain changes at specific spots on these plate surfaces over the course of a single week of ordinary quadrupole mass spectrometer operation. FIG. 4D is a schematic depiction of the zone of impingement 211 of ions or electrons on the surface of either a microchannel plate or a scintillator of an imaging ion detector system such as the systems illustrated in FIG. 1C and FIG. 2. In this discussion, the term "transducer" is used to represent either a microchannel plate or a scintillator plate and is identified in the description of the drawings as transducer 215. In other words, each drawing in which transducer 215 is illustrated may represent either or both of two different objects—a first object in which transducer 215 is a microchannel plate and, possibly, a second object in which transducer 215 is a scintillator plate. In the case in which the transducer is a microchannel plate (MCP), the charged particles are ions; in the case in which the transducer is a scintillator plate, the charged particles are electrons. In either case, the center of the transducer surface is depicted at 213.

The region of ion impingement 211 of the transducer 215 comprises two sub-regions, denoted as sub-region 219*a* and sub-region 219*b*. Sub-region 219*a* is a portion of the region 211 within which the charged particles carry sufficient energy to cause rapid degradation of the response of the transducer for a period of time after the transducer is put into service. Sub-region 219*b*, which is the remainder of zone of impingement region 211, is a portion of the transducer surface within which a measurable amount of charged particles impact the transducer surface but within which the total energy flux is not so great as to cause significant change in the response of a new transducer over short time periods (e.g., several weeks). Although drawn in FIG. 4D with sharp demarcation lines, the outer boundary of region 211 and the boundary between sub-region 219*a* and sub-region 219*b* are in fact gradational. Also, the relative dimensions of the transducer 215 and the regions 219*a*-219*b* are schematic and not necessarily drawn to scale.

When the transducer 215 is appropriately aligned near an exit aperture of the rods X1, X2, Y1, Y2 (see FIG. 5A), of a quadrupole mass analyzer, the transducer center 213 coincides with the projection of the central longitudinal axis 210 of the quadrupole onto the surface. Because the central longitudinal axis is the location of a pseudopotential well within the quadrupole, all ions that have stable trajectories oscillate about that axis and pass multiple times through a narrow region about the axis as they move through the quadrupole. Accordingly, the sub-region 219*a* of an MCP receives the greatest quantity of ions over time and the sub-region 219*a* of a corresponding scintillator plate receives the greatest quantity of electrons over time because of guiding of the ions by a great potential difference along the central longitudinal axis 210. Thus, the sub-region 219*a* is herein referred to as the zone of ion focusing and is the zone of greatest signal intensity in an ion image produced by an imaging system of the type depicted in FIG. 1C and FIG. 2. Unfortunately, the image details derived from the sub-region 219*a* can be biased by the transducer aging over the time because the sub-region 219*a* has the greatest probability of being impacted by ions or electrons, regardless of m/z value. Conversely, the signal derived from sub-region 219*b* is less intense than the signal derived from sub-region 219*b* but nonetheless exhibits greater variability with m/z (see FIG. 1B). Mathematical analysis of a time sequence of images requires information from both of the sub-regions 219*a*, 219*b* in order to fully resolve component signals corresponding to different respective ion m/z values.

The data processing of imaging quadrupole mass spectrometer systems such as those depicted in FIG. 1C and FIG. 2 comprises deconvolution steps that decompose the complex overlapping data generated by multiple emergent ion species into individual component images, where each component image relates to a one of those species. The data processing further comprises recognition of the temporal variation of such component images. Such data processing steps, which are sensitive to variations of spatial patterns of emerging ions, require consistent measurements from the detection system. If the sensitivity of the detection system should deviate from its condition during the most recent calibration, then system re-calibration is required to prevent data processing performance degradation or complete failure. A weekly calibration schedule, as suggested by longevity experiments, may not be acceptable for most users. Accordingly, there is a need in the art to expand the effective period of the detector calibration in quadrupole mass spectrometer systems that detect ion spatial patterns.

SUMMARY

In view of the needs in the art of mass spectrometry, the inventor has devised apparatus and methods to prolong the duration of time that a single calibration may be successfully employed when performing mass analyses with a time and position imaging mass spectrometer. Apparatuses in accordance with the present teachings may incorporate one or both of the group consisting of: (a) a stack of three or more micro-channel plates (MCPs) and (b) a scintillator plate, e.g. a Ce:GAGG (cerium-doped gadolinium aluminum gallium garnet), in the form of either a sintered powder or a single crystal. The multi-plate MCP stack comprising three or more individual plates that disperse the potential gradient such that the aging of each plate during mass spectrometer operation is more gradual over time as compared to operation using fewer than three plates. For a high MCP gain operation, the plates at the end stage that receives most electrons may require a pre-aging process to stabilize the gain variation. The use of Ce:GAGG as a phosphorescent material is found to yield a higher photon gain than does the conventional Ce:YAG, while also exhibiting more resistance to aging.

The present teachings also includes various methods of operation of a time and position imaging mass spectrometer that reduce the rate of aging of MCP and scintillator components (both referred to as "transducers" in the present document). In a first set of such methods, an MCP stack and/or a scintillator is/are physically migrated over the course of operation of the mass spectrometer, such that an ion beam, in the case of an MCP stack, or a beam of electrons, in the case of a scintillator, is/are caused to migrate across the face of the respective transducer, thereby reducing the rate of exposure of any point on a scintillator surface to a beam of incident charged particles. The movement of the transducer(s) may be either continuous or stepwise and, preferably, is effected by at least two mechanical actuators physically coupled to a carriage to which the transducers are mounted. Preferably, a first actuator and a second actuator effect movement in mutually orthogonal directions, such as along the x-axis and along the y-axis, these axes being defined in relation to the quadruple axes. The movement may be parallel to either axis or, alternatively, may be at an non-parallel to both axes. Preferably, the movement of the transducers is in accordance with a predefined pattern of movement.

According to a second set of methods in accordance with the present teachings, an MCP stack and/or a scintillator is/are maintained stationary with respect to the quadrupole while an ion beam within the quadrupole is caused to migrate about the central longitudinal axis by controlled application of separate, independent, non-equal DC potentials to at least two rods that are diametrically opposed to one another with respect to the quadrupole's central longitudinal axis. Similar to the effect of physical movement of the transducers, the execution of this method may cause an ion beam to gradually migrate about the surface of the MCP. The corresponding electron is thereby simultaneously caused to migrate about the surface of the associated scintillator plate. Imbalanced voltages may be controllably applied across the pair of x-rods and across the pair of y-rods such that the particle beams are caused to migrate in accordance with a predetermined pattern relative to the x and y axes. The migration of the ion beam may be either continuous or stepwise.

The above-outlined methods, in which either the ion beam or a transducer is repositioned or migrated, assures that the ion beam or electron beam does not remain stationary at any one particular position of the associated transducer for an extended period of time, thereby reducing the rate of response degradation across the transducer surfaces and permitting an imaging mass spectrometer ion detector to operate for extended periods of time between calibrations. These methods may be employed in conjunction with a known time and position imaging mass spectrometer detector system, such as one of the detector systems illustrated in FIG. 1C and FIG. 2 or other such systems as described in U.S. Pat. No. 8,389,929, which is hereby incorporated by reference in its entirety. Alternatively, these methods may be employed in conjunction with a time and position imaging mass spectrometer detector system that is modified with either one or both of the modifications illustrated in FIG. 5B.

According to another set of methods in accordance with the present teachings, a time and position imaging mass spectrometer is operated such that a supplemental low-frequency alternating-current (AC) voltage waveform is applied to rods of the quadrupole. The frequency (or component frequencies) of the AC wave is/are chosen to match to the secular frequency or frequencies of targeted mass-to-charge ratios during a mass analysis experiment. This low-frequency AC waveform may be phase synchronized to the scanning RF waveform and can be applied on either two pairs of the rods with opposite phase or on just one opposing pair of the rods. As is well known in the art of mass spectrometry, such resonant excitation imparts additional energy to the ions comprising the targeted m/z values, thus increasing the oscillation amplitude of such excited ions. The amplitude of the AC waveform is chosen such the ions having the targeted m/z values are caused to have a greater probability of being detected away from (instead of within) the zone of ion focusing and such that the targeted ions are not laterally ejected from the interior of the quadrupole. The increased oscillation amplitude of these ions causes a diminishing of ion flux at the center of a transducer, thus reducing the rate of aging of the transducer within the mass spectrometer.

According to another set of methods in accordance with the present teachings, a transducer (either an MCP or a scintillator) may be "pre-aged" prior to putting the transducer into service within a time and position imaging mass spectrometer system. The pre-aging may be effected by causing a beam of electrons to impinge upon all or a portion of a surface of a transducer, under the impetus of an electrical potential difference between the emitter and the transducer. Once placed into service within a mass spectrometer, the pre-aged portions of the transducer will be less susceptible to additional degradation of transducer response as compared to non-aged transducers or non-aged portions of a single transducer. By this means, the duration of the validity of mass spectrometer detector calibrations may be prolonged once the transducer is placed into service, since the utility of such calibrations depends upon constancy of detector response.

The pre-aging of a transducer may be uniform across the surface of the transducer or, alternatively, in accordance with a pre-determined pattern. In some methods of the present teachings, an aging pattern may imposed upon the transducer by selectively and controllably sweeping or rastering the electron beam across all or portions of the transducer. The sweeping or rastering of the beam may be accomplished by either physical movement of the emitter and transducer relative to one another or, preferably, by controlled progressive electromagnetic deflection of the beam according to a raster pattern. In other methods of the present teachings, the aging pattern may be imposed upon the transducer by passing the electron beam through a mask that it interposed between the electron emitter and the transducer, wherein the mask comprises an encoded beam attenuation pattern that corresponds to or reflects a desired pre-aging pattern of the transducer. According to this method, the emitter, mask and transducer are preferably configured such that there is a one-to-one mapping between each point on the transducer at which the electron beam is incident and each point of the mask through which the beam passes. The degree of beam attenuation at each point on the mask is then reflected, in an inverse sense, in the number of electrons that are allowed to impact the respective corresponding point on the transducer surface.

The final imposed pattern, as a result of either beam sweeping or rastering or mask attenuation, comprises different degrees of pre-aging at different portions of the transducer. In other words, the amount of pre-aging is a function of position on the transducer surface, the function corresponding to or being a reflection of the pre-determined pattern. The pre-determined pre-aging pattern may be advantageously chosen to correspond to an expected pattern of ion flux emerging from a quadrupole mass analyzer. Preferably, the degree of pre-aging is greatest at a position of positions on the transducer surface upon which the greatest number of ions are expected to impinge. Accordingly, the pattern of aging of the pre-aged transducer should be positioned or rotationally aligned with quadrupole rods in a mass spectrometer in accordance with a pre-determined alignment orientation such that the imposed pre-aging pattern corresponds to a pattern of expected ion flux. Generally, the greatest number of ions are expected at a zone of ion focusing that corresponds to a central region surrounding a point that corresponds to an extension of a quadrupole's central longitudinal axis. With the transducer appropriately position and/or aligned and the ion flux pattern as expected, the portions of an ion beam comprising the greatest ion flux will intercept the transducer surface at the regions of greatest degree of pre-aging, at which the transducer is least susceptible to degradation of its response. At the same time, the more-usefully-diagnostic portions of the ion beam comprising lesser beam flux will intercept the transducer at the regions of least or no pre-aging, at which the transducer is most sensitive to small variations in beam flux.

A transducer that is pre-aged specifically for use in a time and position imaging mass spectrometer is considered to be an apparatus in accordance with the present teachings. Likewise, the method of pre-aging a transducer specifically for use within a time and position imaging mass spectrometer is considered to be a method in accordance with the present teachings. Similarly, operation of a time and position imaging mass spectrometer using such a pre-aged transducer or transducers is considered to be a method in accordance with the present teachings.

A time and position imaging mass spectrometer that is in accordance with the present teachings may be operated in accordance with any method that is in accordance with the present teachings. For example, a time and position imaging mass spectrometer that includes any combination of: (a) an MCP comprising three or more plates; (b) a scintillator of the composition described herein; and (c) one or more pre-aged scintillators may be operated in accordance with any combination of: (1) scintillator physical position migration; (2) ion beam positional migration; and (3) expansion of an ion beam by resonant excitation of one or more selected targeted m/z values. All such combinations are considered to be embodiments of the invention.

BRIEF DESCRIPTION OF THE DRAWINGS

The above noted and various other aspects of the present invention will become further apparent from the following description which is given by way of example only and with reference to the accompanying drawings, not drawn to scale, in which:

FIG. 8A is a schematic depiction of a set of quadrupole rods of a mass analyzer indicating the application, to the rods, of a scanning RF voltage (labeled as RF0 and RFπ), a first (scanning) DC1 voltage (labeled as DC1+ and DC1−) and a steering DC voltage (labeled as DC2*a* through DC2*b*);

FIG. 8B is a schematic depiction of a pattern of steering of an ion beam on a micro-channel plate such that aging of the microchannel plate and an associated scintillator is evenly distributed over a certain region of each of the microchannel plate and scintillator;

DETAILED DESCRIPTION

Figure 1A:
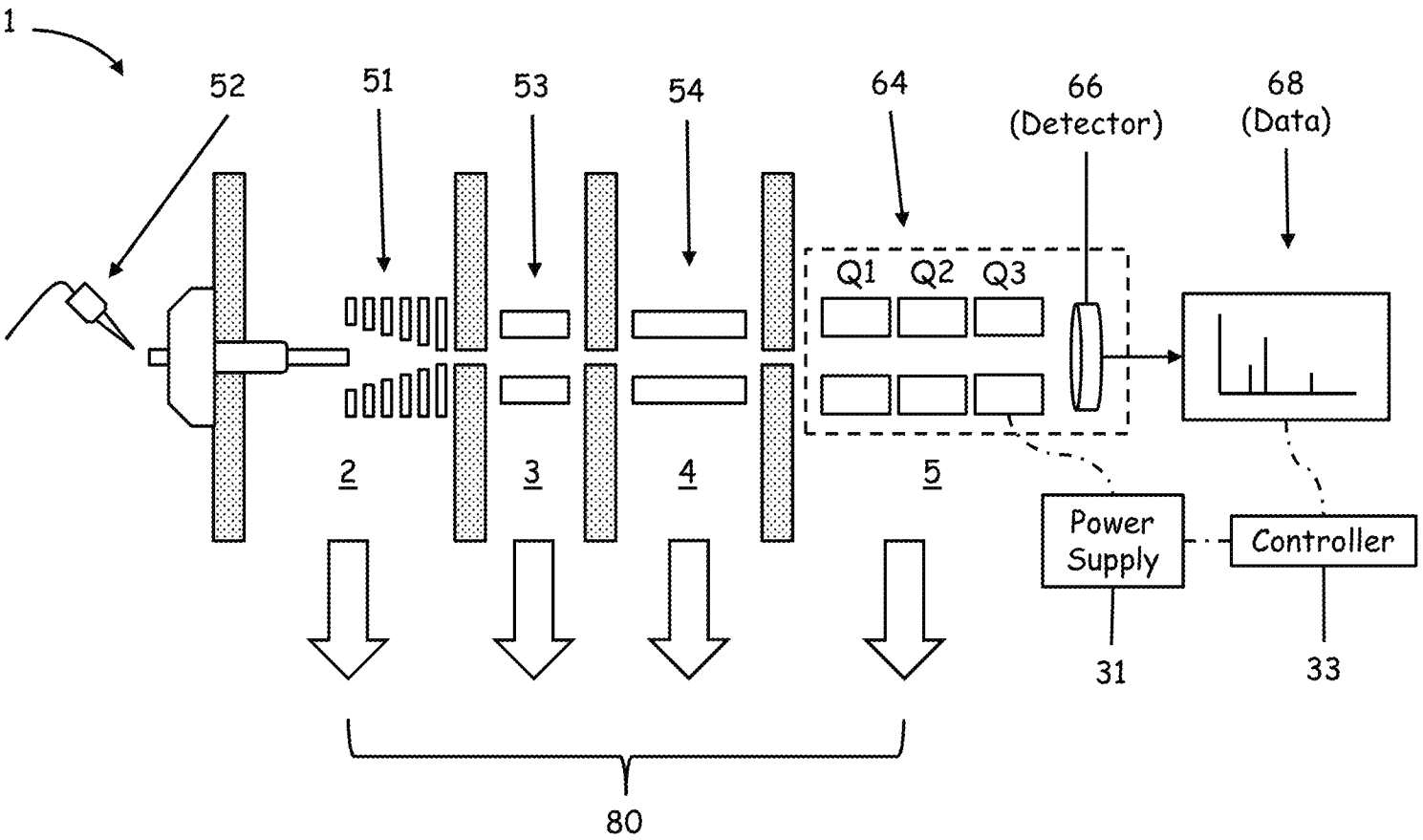
FIG. 1A (Prior Art)
FIG. 1A is a schematic example configuration of a triple stage mass spectrometer system.
Figure 1B:
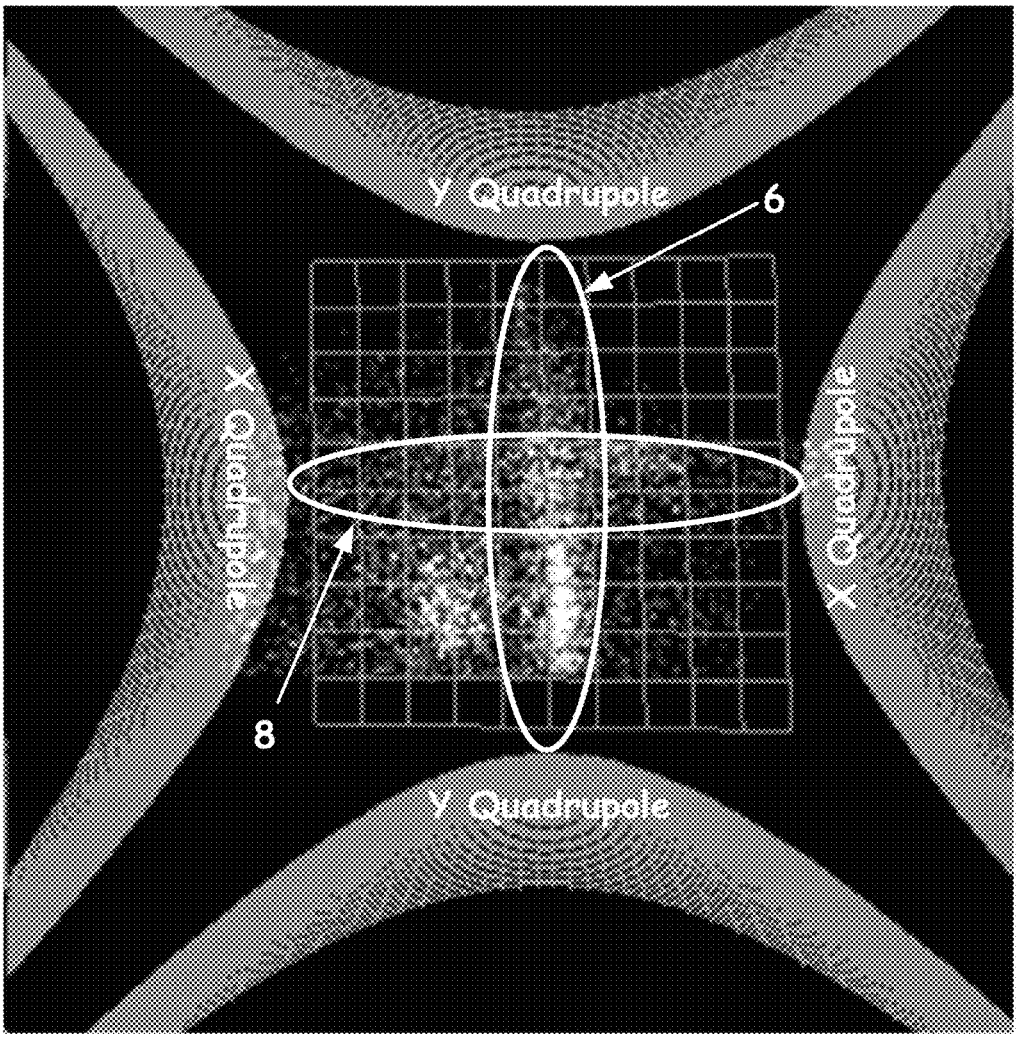
FIG. 1B (Prior Art)
FIG. 1B is a simulated recorded image of a multiple distinct species of ions as collected at the exit aperture of a quadrupole at a particular instant in time.
Figure 3:
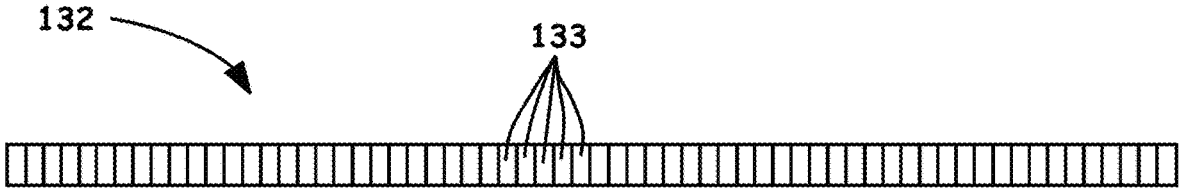
FIG. 3 is a schematic illustration of a linear photo-detector array.
Figure 1C:
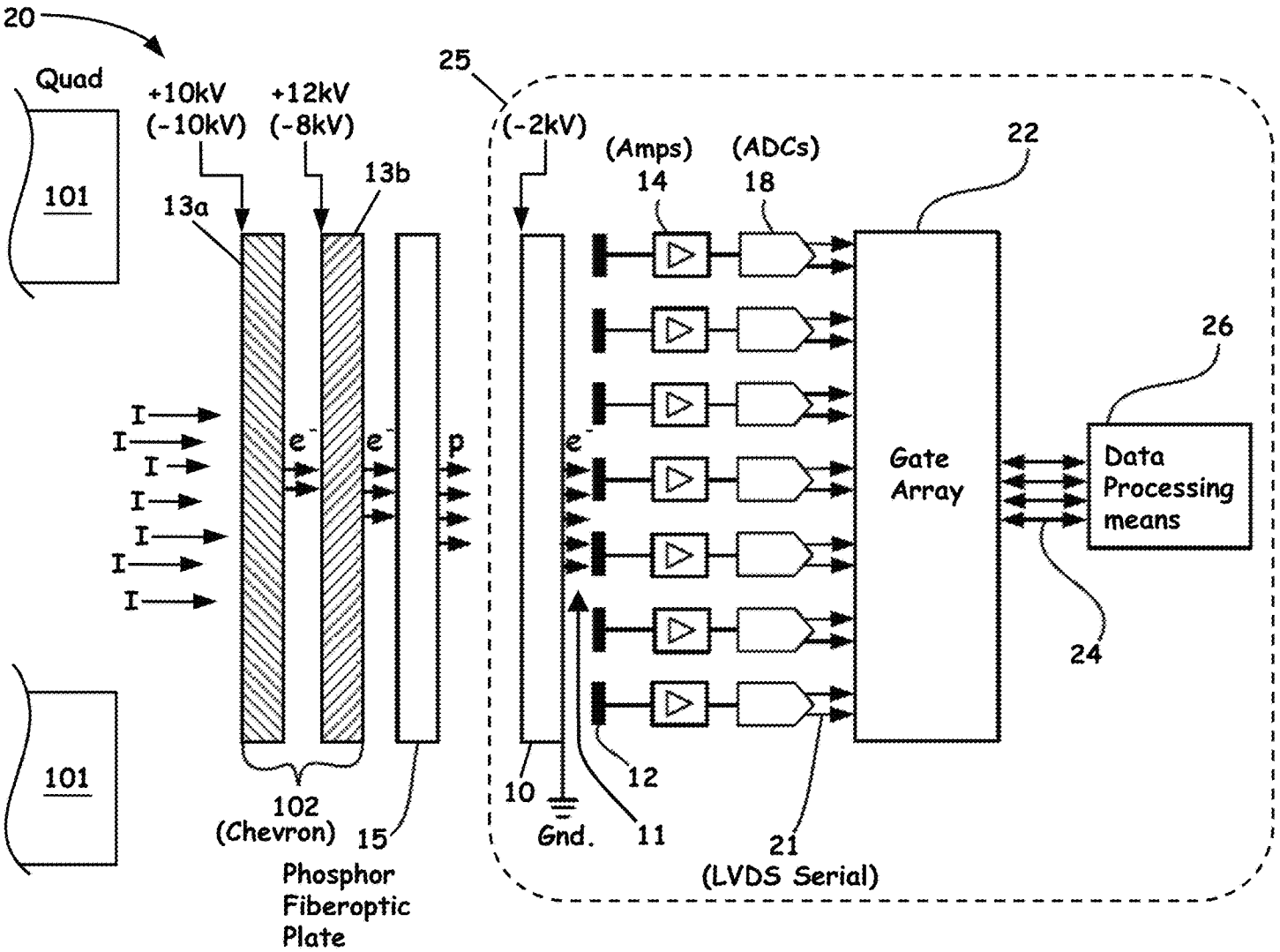
FIG. 1C (Prior Art)
FIG. 1C is a schematic depiction of a known time and position imaging ion detector system configured with a linear array of read-out anodes.
Figure 2:
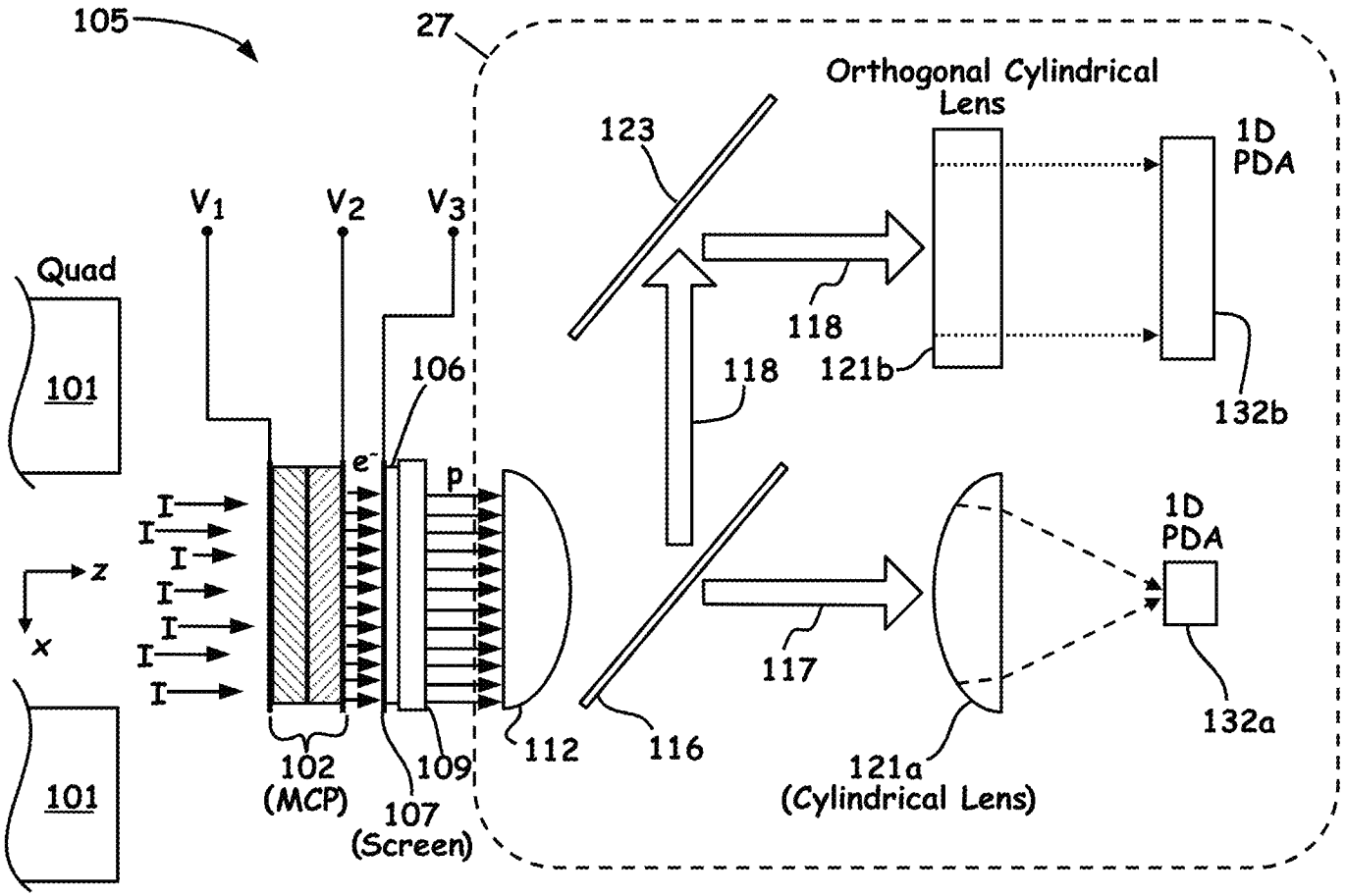
FIG. 2 (Prior Art)
FIG. 2 is a schematic depiction of a second known time and position imaging ion detector system that employs two linear photo-detector arrays.

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended FIGS. 1-13.

In the description of the invention herein, it is understood that a word appearing in the singular encompasses its plural counterpart, and a word appearing in the plural encompasses its singular counterpart, unless implicitly or explicitly understood or stated otherwise. Furthermore, it is understood that for any given component or embodiment described herein, any of the possible candidates or alternatives listed for that component may generally be used individually or in combination with one another, unless implicitly or explicitly understood or stated otherwise. Moreover, it is to be appreciated that the figures, as shown herein, are not necessarily drawn to scale, wherein some of the elements may be drawn merely for clarity of the invention. Also, reference numerals may be repeated among the various figures to show corresponding or analogous elements. Additionally, it will be understood that any list of such candidates or alternatives is merely illustrative, not limiting, unless implicitly or explicitly understood or stated otherwise.

Unless otherwise defined, all technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular. As used herein, and as commonly used in the art of mass spectrometry, the term "DC" does not specifically refer to or necessarily imply the flow of an electric current but, instead, refers to a non-oscillatory voltage which may be either constant or variable. Likewise, as used herein, and as commonly used in the art of mass spectrometry, the term "AC" does not specifically refer to or necessarily imply the existence of an alternating current but, instead, refers to an oscillatory voltage or oscillatory voltage waveform. The term "RF" refers to an oscillatory voltage or oscillatory voltage waveform for which the frequency of oscillation is in the radio-frequency range.

Figure 5:
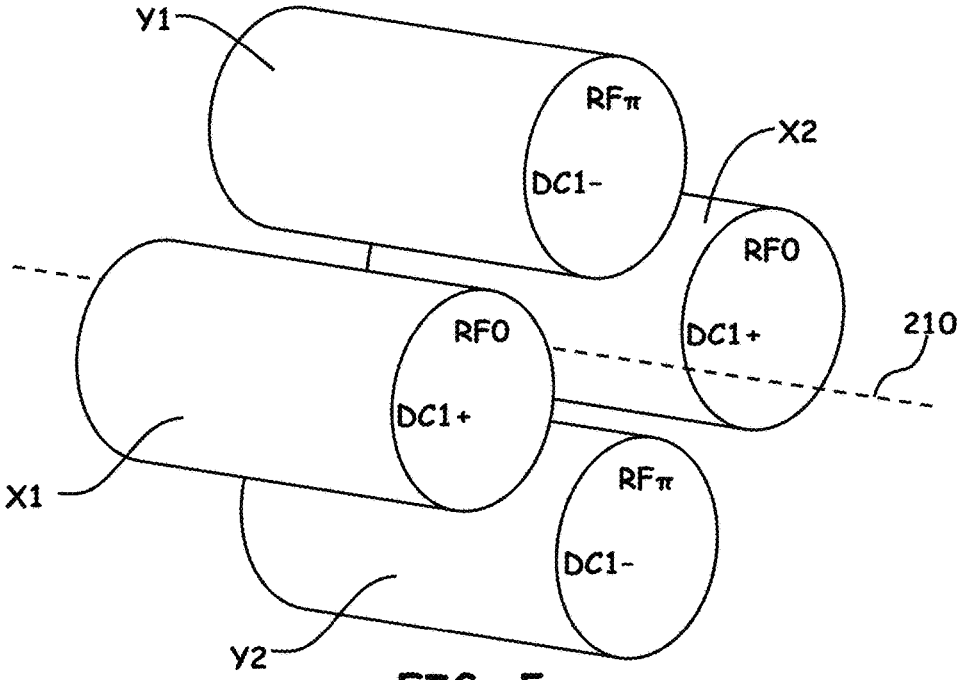
FIG. 5 (Prior Art)
FIG. 5 is a schematic depiction of a set of quadrupole rods of a mass analyzer indicating the conventional application of scanning radio-frequency (RF) voltage (labeled as RF0 and RFπ) and a scanning direct-current (DC) voltage (labeled as DC1+ and DC1−) to the rods.

FIG. 5 is a schematic depiction of a set of quadrupole rods of a mass analyzer. By convention, the four rods are described as a pair of x-rods, denoted in the drawing as rods X1 and X2, and a pair of y-rods, denoted in the drawing as rods Y1 and Y2. The pair of x-rods defines an x-axis that is orthogonal to the long dimension of the rods; likewise, the pair of y-rods defines a y-axis that is orthogonal to both the long dimension of the rods and the x-axis. The four rods together define a central longitudinal axis 210 that is parallel to and disposed midway between the four rods. The central longitudinal axis 210 is also denoted as the z-axis which is orthogonal to both the x-axis and y-axis.

As in conventional operation, a scanning radio-frequency (RF) oscillatory voltage, RF0, RFπ, and a scanning direct-current (DC) voltage, DC1+, DC1−, are applied to the rods, with the RF phase applied to the x-rods being exactly π radians out of phase with respect to the phase applied to the y-rods. In other words, the RF potential on the y-rods is inverted with respect to the x-rods. These two phases of RF are thus respectively denoted as RF0 and RFπ in FIG. 5. At any instant of time, the two x-rods have the same potential as each other, as do the two y-rods. Relative to the constant potential at the central longitudinal axis 210, the potential on each set of rods can be expressed as having a DC component plus an RF component that oscillates rapidly (with a typical frequency of about 1 MHz). The DC potential on the x-rods is positive (relative to the potential on the z-axis) so that a positive ion feels a restoring force that tends to keep it near the z-axis; the potential in the x-direction is like a well. Conversely, the DC potential on the y-rods is negative (relative to the potential on the z-axis) so that a positive ion feels a repulsive force that drives it further away from the z-axis; the potential in the y-direction is thus like a peak. In accordance with the above observations, the DC potential on the x-rods is denoted as DC1+ and the DC potential on the y-rods is denoted as DC1− in FIG. 5 and similar figures. The term "DC voltage", as used herein, refers to the difference between these two potentials.

Within the quadrupole, ions move inertially along the z-axis from the entrance of the quadrupole to a detector often placed at the exit of the quadrupole. The ions have trajectories that are separable in the x and y directions inside the quadrupole. In the x-direction, the applied RF field carries ions with the smallest mass-to-charge ratios out of the potential well and into the rods. Ions with sufficiently high mass-to-charge ratios remain trapped in the well and have stable trajectories in the x-direction; the applied field in the x-direction acts as a high-pass mass filter. Conversely, in the y-direction, only the lightest ions are stabilized by the applied RF field, which overcomes the tendency of the applied DC to pull them into the rods. Thus, the applied field in the y-direction acts as a low-pass mass filter. Ions that have both stable component trajectories in both x and y pass through the quadrupole to reach the detector. The DC offset and RF amplitude can be chosen so that only ions with a desired range of m/z values are measured. If the RF and DC voltages are fixed, the ions traverse the quadrupole from the entrance to the exit and exhibit exit patterns that are a periodic function of the containing RF phase. Although where the ions exit is based upon the separable motion, the observed ion oscillations are completely locked to the RF. As a result of operating a quadrupole in, for example, a mass filter mode, the scanning of the device by providing ramped RF and DC voltages naturally varies the spatial characteristics with time as observed at the exit aperture of the instrument. As is well-known, the applied DC voltage may be ramped in coordinated fashion with the amplitude of the applied RF voltage waveform such that the narrow range of m/z ratios progressively increases as the voltage magnitude and amplitude are ramped. Accordingly, in this document, the applied RF and DC voltages are referred to as scanning RF and scanning DC voltages, respectively.

Furthermore, a supplemental resonant excitation alternating current (AC) voltage may optionally be applied to the rods for the purpose of selectively resonantly amplifying the spatial oscillations, about the axis 210, of ions having certain m/z values, as discussed further below. The applied AC voltage is an oscillatory voltage that is distinguished from the applied RF voltage by its much lower amplitude and somewhat lower frequency. The phases of the applied supplemental AC voltage are denoted, in FIG. 9A, as AC+ and AC−.

Figure 6:
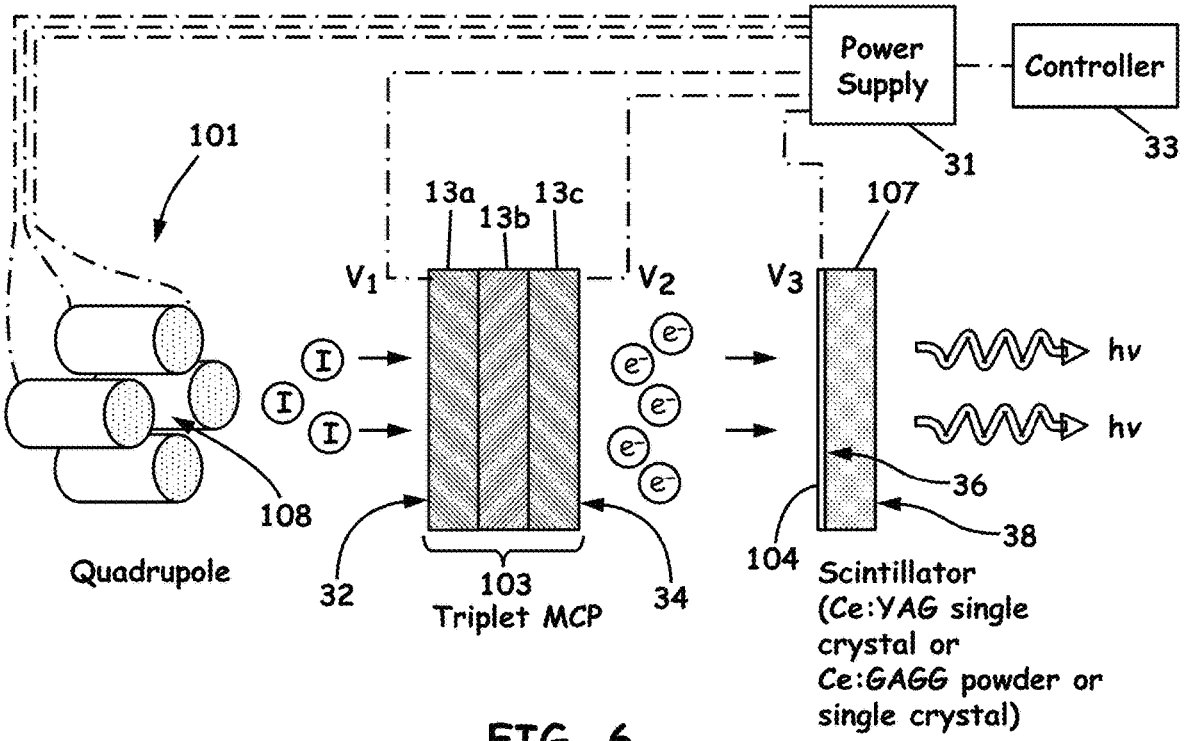
FIG. 6 is a schematic depiction of an imaging ion detector having a stack of microchannel plates and a scintillator in accordance with the present teachings.

FIG. 6 schematically depicts a quadrupole rod set 101 and a portion of a time and position imaging ion detector system for a mass spectrometer in accordance with the present teachings. The configuration illustrated in FIG. 6 is very similar to the configuration of FIG. 4A. A stream or flux of ions I impinges on a front face 32 of MCP stack 103 and, in response, a stream or flux of electrons $e^-$ are emitted from a rear face 34 of the MCP stack. The ions I are urged towards the MCP stack from the quadrupole 101 under the influence of biasing voltage $V_1$ provided by high-voltage supply 31. Ejected electrons are propelled from the first (upstream) MCP 13*a* of the stack to the last MCP 13*c* (downstream) and then to a front surface 36 of a phosphorescent scintillator 107 under the influence of biasing voltages $V_2$ and $V_3$. The voltage $V_3$ may be supplied to a thin-film electrode coating 104 on the front surface 36 of the scintillator 107. In response to the impingement of electrons on the front surface 36 of the scintillator 107, photons (hv) are generated within the scintillator and emitted from its rear surface 38.

An electronic controller 33, which may be a programmed computer or other integrated circuitry that is programmed by firmware, controls the application of voltages to the MCP and electrode 104 and also controls the application of radio frequency (RF) and other voltages to the rod electrodes of quadrupole 101. In well-known fashion, the electronic controller 33 may cause the power supply 31 to vary the application of scanning RF and scanning direct current (DC) voltages to the rods over the course of a scan time period during which these scanning voltages are controllably varied such that ions of progressively increasing or progressively decreasing m/z are emitted from the quadrupole exit aperture 108. The electronic controller 33 may also cause the power supply 31 to apply additional voltages to the rods as in accordance with the present teachings and as discussed further herein below. The electronic controller 33 may also control the operation of optional actuators that are coupled to one or both of the scintillator 107 and the MCP stack 103 as discussed further herein below. The application of any additional voltages and operation of any actuators may, in some instances, be coordinated with or in synchronization with the application of the scanning RF and DC voltages to the quadrupole rods.

Figure 4A:
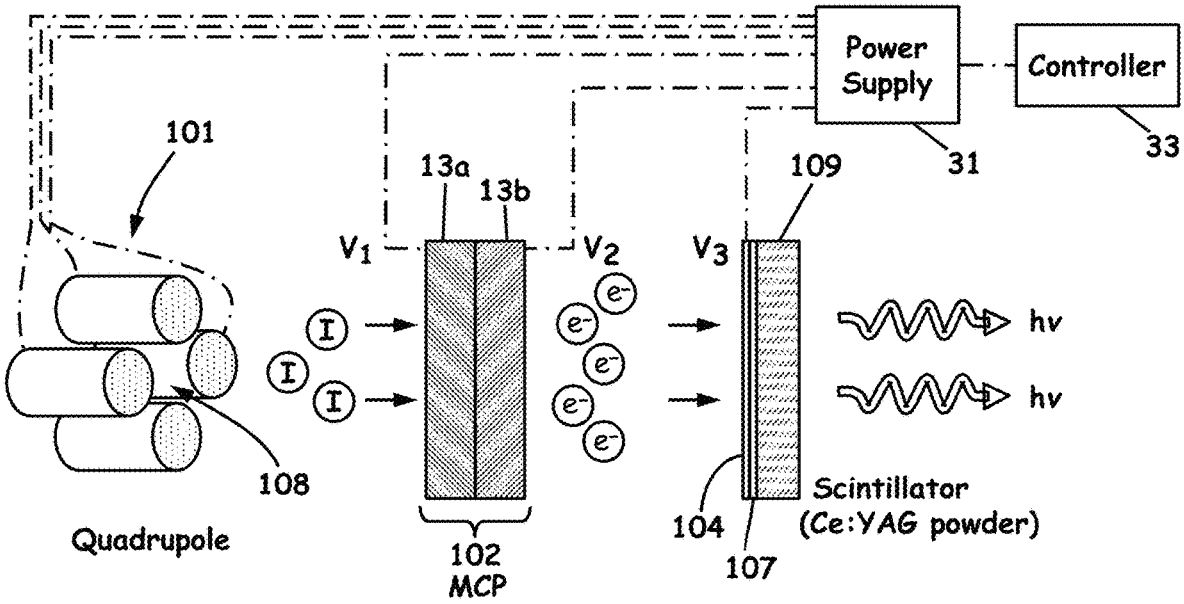
FIG. 4A (Prior Art)
FIG. 4A is a schematic depiction of a known imaging ion detector having a micro-channel plate and a scintillator.
Figure 4B:
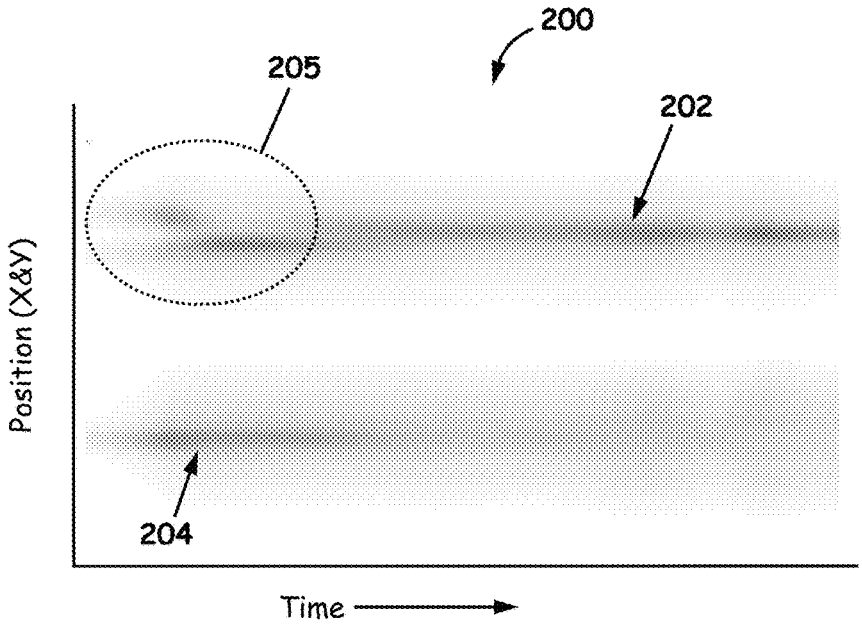
FIG. 4B is a graphical depiction of the measured time variation of detected ion current along both the X- and y-directions of ions emitted from a quadrupole mass analyzer, as measured by an apparatus of the type illustrated in FIGS. 1C and 2.
Figure 4C:
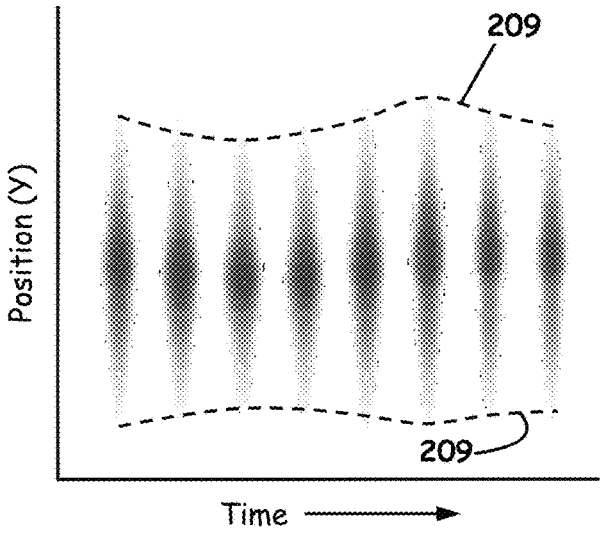
FIG. 4C is an expanded view of the variation of detected ion current along the y-direction at the exit aperture of a quadrupole mass analyzer, as measured by an apparatus comprising the components depicted in FIG. 4A.
Figure 4D:
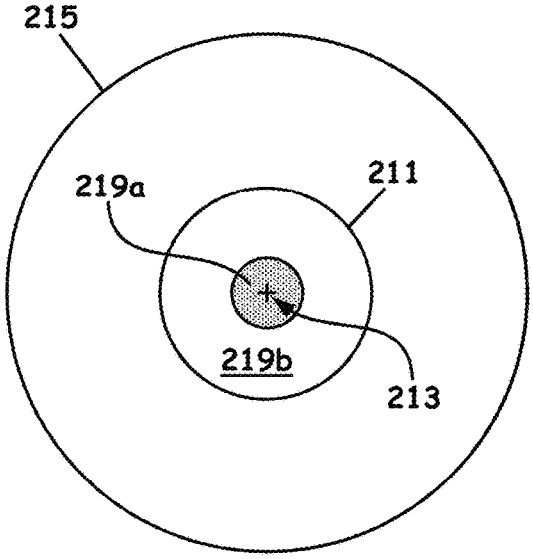
FIG. 4D is schematic depiction of the zone of impingement of ions or electrons on the surface of either a microchannel plate or a scintillator of an imaging ion detector system, further illustrating a zone of accelerated aging of the microchannel plate or scintillator.

The configuration illustrated in FIG. 6 differs from that shown in FIG. 4A in that: (a) the scintillator 107 modified by replacement of the conventional Ce:YAG phosphor powder either with a single crystal of phosphor material, e.g. Ce:YAG or Ce:GAGG (cerium-doped gadolinium aluminum gallium garnet); and (b) the MCP stack 103 comprises at least three separate microchannel plates, which are exemplified by plates 13*a*, 13*b* and 13*c* in FIG. 6. Although both such modifications are illustrated in FIG. 6, alternative systems are contemplated which only include one of modification (a) or modification (b) as listed above. As a further alternative, the Ce:GAGG phosphor could be provided as a sintered powder on a front surface of a substrate plate 109, in similarity to the system illustrated in FIG. 4A. The single crystal scintillator, if employed, has the form of a flat plate of thickness less than or equal to 1 millimeter.

The first above-noted modification to the detection system arises from the inventor's observations that single crystal scintillator plates are more resistant to aging than are powders and that the use of Ce:GAGG as a phosphorescent material yields a higher gain than Ce:YAG while also exhibiting greater resistance to aging. If the Ce:GAGG is provided as a sintered powder, then the configuration is as illustrated in FIG. 4A, with the Ce:GAGG powder coated onto a non-phosphorescent substrate plate. Alternatively, this material is available as a clear single-crystal plate having a thickness of approximately 100 μm. In the alternative configuration in which the scintillator (either Ce:YAG or Ce:GAGG) comprise a single crystal plate, there may be no substrate plate, since the scintillator plate 107 can itself be free standing. With regard to the MCP stack, when three or more microchannel plates are incorporated into such a Z stack, reduced ion feedback can slow down the photocathode aging. The potential gradient is also dispersed over the several plates, and thus each individual plate may experience less electron cluster bombardment when three or more microchannel plates are employed.

Various methods of operating a time and position imaging mass spectrometer so as to reduce the rate of aging of MCP and scintillator components (both referred to as "transducers" in the present document) are now discussed. According to a first set of such methods, a pair of actuators (not shown) are employed to cause motion of at least one of the stack of microchannel plates (MCP) and the scintillator relative to a stationary ion beam that is emergent from a quadrupole. Such methods cause migration of the ion beam across, over, about or around the surface of at least one of the transducers. Preferably, the transducer of transducers that are to be moved are supported on or in a moveable carriage (not shown) that is movably coupled to the mass spectrometer housing and that is coupled to the actuators and that is configured for translational motion within a plane that is parallel to both the x and y axes, as defined in reference to the associated quadrupole. In operation, the actuators are controlled as to migrate the position of at least one transducer or to simultaneously migrate the positions of both transducers with respect to the ion beam over the course of a pre-determined time period—such as a few days to a few weeks. By means of this gradual positional migration of the MCP and/or scintillator plate, the region of beam focusing is caused to continuously impinge upon a non-aged (or less-aged) portion of each transducer surface. The gradual migration of the ion or electron beam over the surface of the respective transducer extends the period of time between which the transducers need to be re-calibrated in order to account for the aging.

Figure 7:
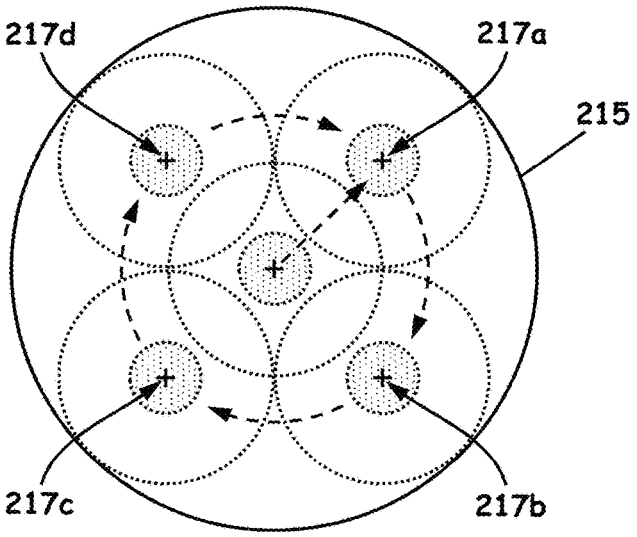
FIG. 7 is a schematic depiction of an example pattern of migration of a charged particle beam over the surface of a microchannel plate during transmission of ions onto the microchannel plate during a course of mass analysis during which the microchannel plate is physically moved with respect to the quadruple, the pattern also pertaining to an associated scintillator if the scintillator is moved in concert with the movement of the microchannel plate.

FIG. 7 is a schematic depiction of one example of a pattern of movement of an ion or electron beam plate over the surface of a transducer during a program of experimentation in which the position of the transducer is migrated by the coordinated operation of both a first actuator (not shown) that translates the transducer parallel to the x-direction and a second actuator (not shown) that translates the transducer parallel to the y-direction. Dashed-line arrows in FIG. 7 depict a hypothetical pattern of movement in which the beam position is first gradually displaced from its initial location at the center 213 of the transducer towards a location near the transducer periphery and then caused to migrate around the periphery. The positions 217*a*, 217*b*, 217*c* and 217*d* represent four such positions of the migrated beam. The beam position may not remain static at each illustrated position; in operation, there may be a continuum of intermediate positions between those that are illustrated as the beam continuously migrates about the surface of the transducer. Although the transducers 215 are caused to move relative to the ion beam during operation of this method, the image of the ion beam on the scintillator plate nonetheless remains fixed relative to the positions of the quadrupole, the ion beam and the optical lenses and detectors. Thus no modifications are required to the optics or to the detectors.

According to a second set of methods, in accordance with the present teachings, for migrating an ion beam relative to paired MCP and scintillator transducers, the transducers 215 remain fixed relative to the quadrupole. Instead, the ion beam is itself translated (referred to herein as "steering") by applying supplemental, independent DC potentials, denoted as DC2*a*, DC2*b*, DC2*c* and DC2*d* in FIG. 8A, to the quadrupole rods. Imbalanced potentials may be controllably applied across the two rods of either or both pairs of rods in which the rods are diametrically opposed to one another so as to cause the location of the pseudopotential well to shift laterally within the quadrupole. In other words, the potential imbalance may be across either the pair of x-rods and/or the pair of y-rods. The shift of the pseudopotential well causes a slight translation of the zone of maximum ion concentration within the quadrupole away from the quadrupole's central axis (which remains centrally located between the rods). This shifting of the ion beam causes the center of the region of ion impingement 211 to migrate away from the transducers' center 213.

Figure 12B:
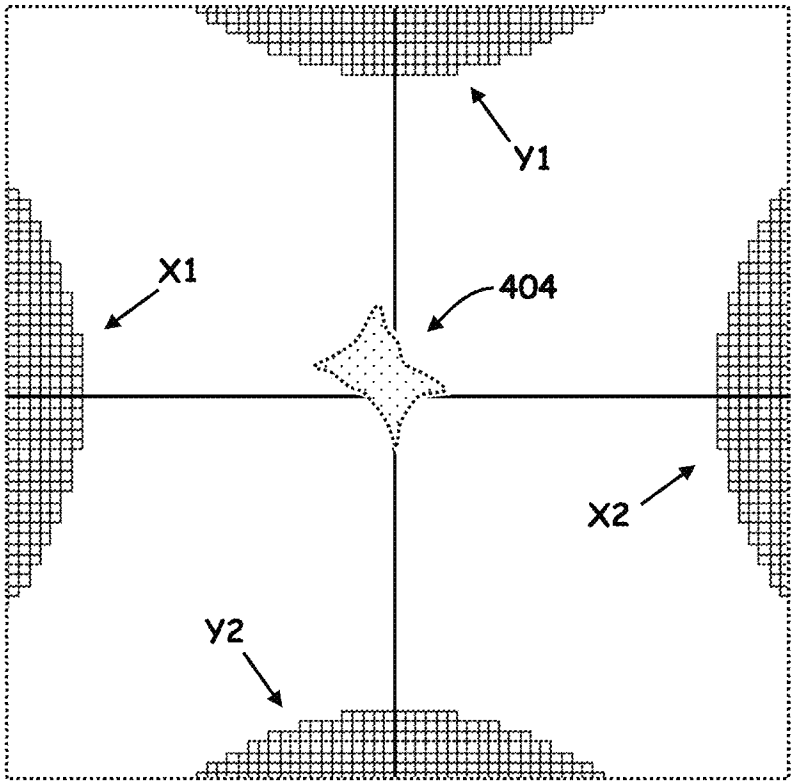
FIG. 12B is a schematic depiction of a cross-section of a quadrupole mass filter at its exit aperture, as in FIG. 12A, showing an expected distribution of ions exiting the apparatus under the application of the RF and DC voltages as in FIG. 12A and as supplemented by an additional applied constant DC potential difference between the X-rods and an applied constant DC potential difference between the Y-rods.
Figure 12A:
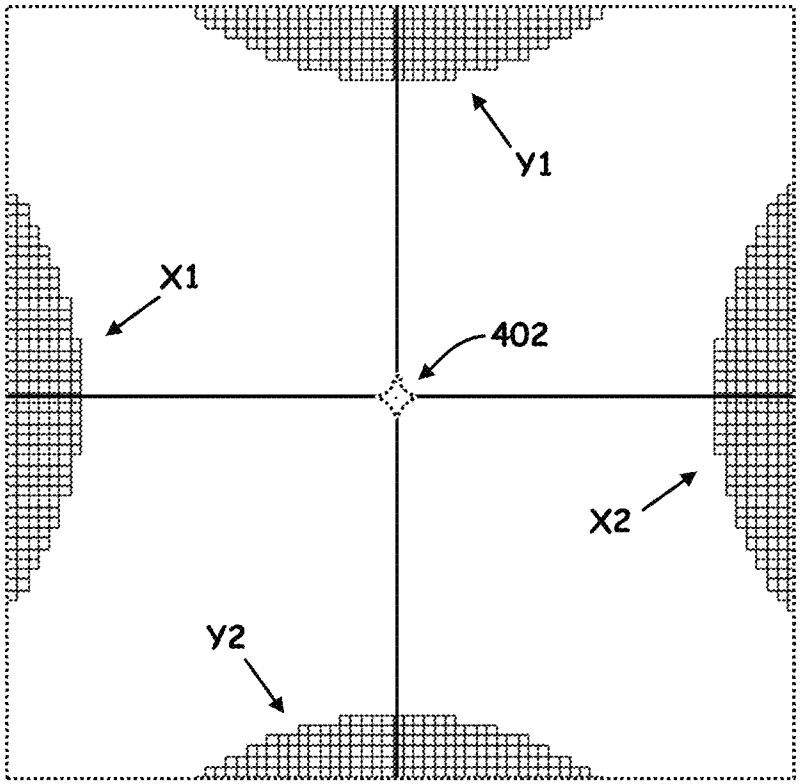
FIG. 12A is a schematic depiction of a cross-section of a quadrupole mass filter at its exit aperture showing an expected distribution of ions exiting the apparatus under application of a conventional ramped oscillatory RF voltage and a conventional ramped DC scanning potential difference to the rod electrodes.
Figure 13:
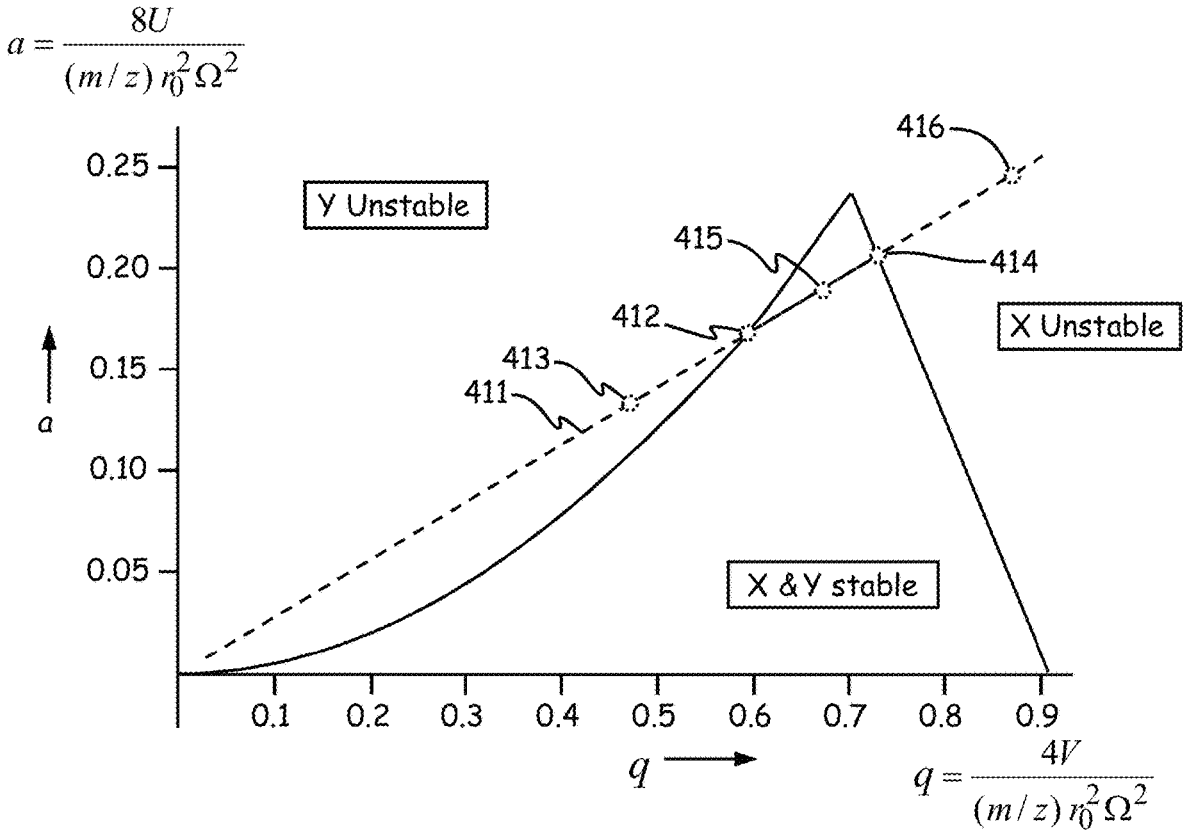
FIG. 13 (Prior Art)
FIG. 13 is a schematic depiction of a Mathieu diagram showing hypothetical plot points corresponding to ions of different m/z ratios along a hypothetical scan line.

The above described ion beam shifting operations may be programmable. For example, if the voltage DC2*a* applied to rod Y1 is more positive than the voltage DC2*c* applied to rod Y2, which is diametrically opposed to rod Y1, then a pseudopotential well will be displaced away from central longitudinal axis 210 in the direction of rod Y2. In this instance the center of a beam of positive ions within the rods will be similarly shifted. Conversely, if voltage DC2*c* is more positive than voltage DC2*a*, then the pseudopotential well will be displaced away from central longitudinal axis 210 in the direction of rod Y1. Likewise, differences between voltage DC2*b* and voltage DC2*d* may be applied in a way so as to shift the pseudopotential well in the direction of either rod X1 or rod X2. FIG. 12A is a schematic depiction of a cross-section of a quadrupole mass filter at its exit aperture showing an expected distribution of ions exiting the apparatus under application of a conventional ramped oscillatory RF voltage, that is, without the application of the additional DC voltages DC2*a*, DC2*b*, DC2*c* and DC2*d*. It may be seen that, in this case, the ions exit the mass filter within a tightly restricted cloud 402 centered about the central axis of the apparatus. FIG. 12B illustrates a more-expanded distribution of exiting ions (cloud 404) that is expected when a steering DC potential difference is applied between rods X1 and X2 and a similar-magnitude steering DC potential difference is applied between the rods Y1 and Y2. In this case, the density of ions at the central axis is reduced, leading to a consequent reduction in the rate of a transducer that is disposed adjacent to the exit aperture.

As an added benefit, the provision of these programmable DC steering potentials may be used to effect controlled positional changes during the course of a single m/z scan so as provide a unique coding in the ion trajectories (e.g., a coding such as a constant offset, a spiral or periodical shifts that are phase synchronized to the applied RF). The controlled application of the DC steering potentials can cause beam migration around, about or across a transducer surface so as to reduce the rate of transducer response degradation at any one point on the surface. For example, FIG. 8B illustrates a hypothetical circular beam migration pattern, as might be produced by the application of appropriate beam steering potentials as described above. In this example, the beam repeatedly migrates from point 218*a* to point 218*b* to point 218*c* and to point 218*d* along the surface of micro-channel plate 215. The beam migration may be stepwise, as indicated by the dashed-line circles in FIG. 8B or, alternatively, may be continuous. A similar electron beam migration would occur around, about or across the surface of an associated scintillator. Other hypothetical beam migration patterns are possible, as well.

According to another set of methods in accordance with the present teachings, a supplemental oscillatory alternating current (AC) voltage may optionally be applied to the quadrupole rods for the purpose of selectively resonantly amplifying the spatial oscillations, about the axis 210, of ions having certain m/z values. This oscillatory AC voltage is distinguished from the oscillatory RF voltage by its much lower amplitude and lower frequency. As is well known in the art of mass spectrometry, such resonant excitation imparts additional energy to the ions comprising the targeted m/z values, thus increasing the spatial oscillation amplitude of such excited ions. The amplitude of the AC waveform is chosen such the ions having the targeted m/z values are caused to have a greater probability of being detected away from (instead of within) the zone of ion focusing and such that the targeted ions are not laterally ejected from the interior of the quadrupole.

The increased oscillation amplitude of the resonantly excited ions causes a diminishing of charged particle flux within the central region 219*a* of a transducer 215, thus reducing the overall rate of aging of the transducer within the mass spectrometer. For example, with reference to FIG. 9B, an ion species having a particular m/z may impact an MCP 215 entirely within the region of ion impingement 211 in the absence of the application of the resonant excitation AC voltage. However, when the resonant excitation AC voltage is applied, the zone of impact may expand to encompass the entire stippled region 219*c* because the portion of time spent within the zone of ion focusing by the resonantly excited ions is reduced. (The zone of ion focusing is a cylindrical region within the quadrupole that is concentric with and surrounds the central longitudinal axis 210. The projection of this region onto the MCP 215 is represented as the darkly stippled zone 219*a* in FIG. 9B) As a consequence, the overall ion flux density (ions-cm$^{-2}$-sec$^{-1}$) within the stippled 219*a* is reduced, thereby reducing the rate of aging in this region.

Figure 9A:
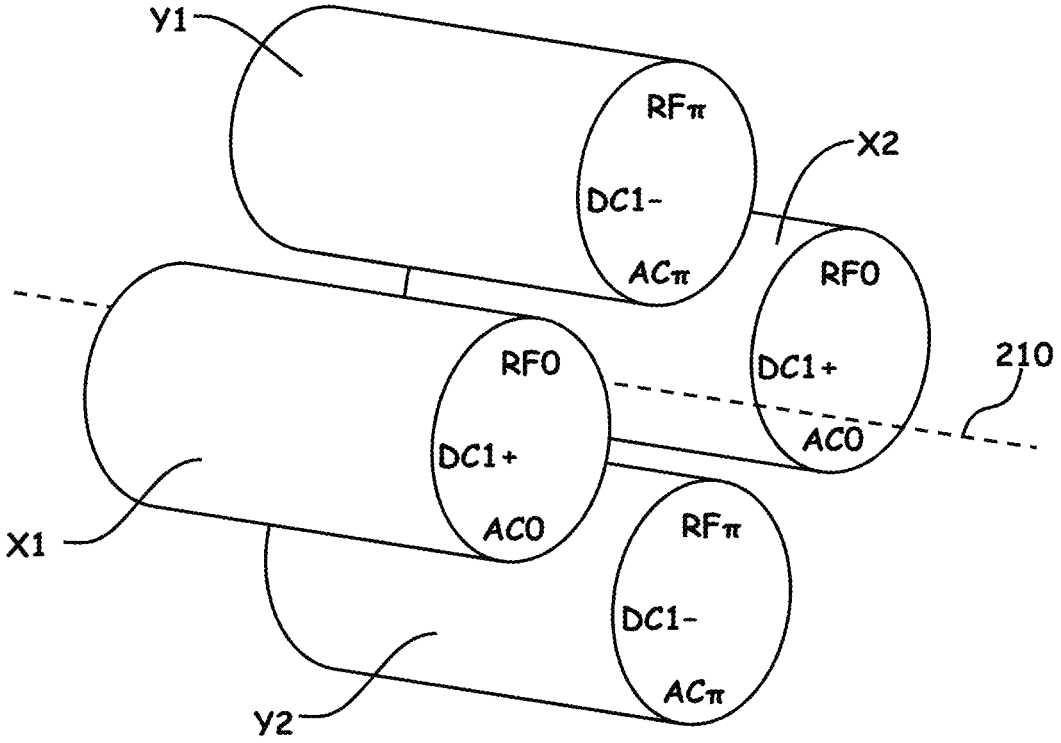
FIG. 9A is a schematic depiction of a set of quadrupole rods of a mass analyzer indicating the application, to the rods, of a scanning RF voltage (labeled as RF0 and RFπr), a scanning DC voltage (labeled as DC1+ and DC1−) and a supplemental oscillatory resonant excitation voltage (labeled as AC0 and ACπ)
Figure 9B:
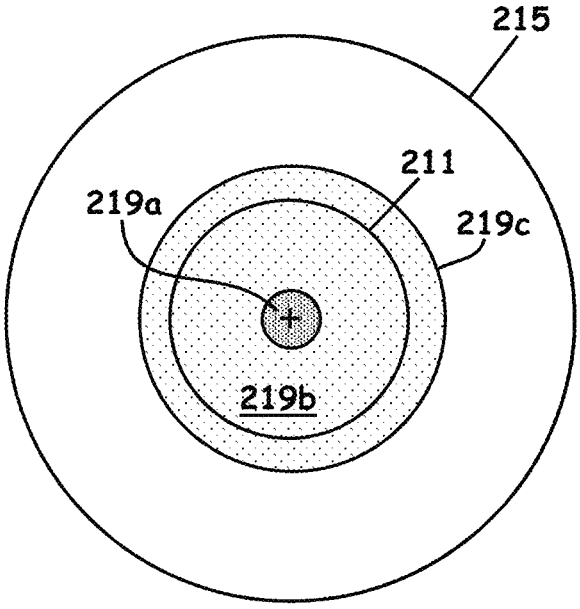
FIG. 9B is is a schematic depiction of shrinkage of the zone of maximum charged particle flux incident onto a microchannel plate or a scintillator under the application of a supplemental oscillatory resonant excitation voltage to the rods of a quadrupole mass analyzer to which the microchannel plate and scintillator are coupled.

The low frequency AC wave that may be phase synchronized to the RF wave can be applied on both pairs of rods, with opposite phase across the rods of each pair (i.e., a quadrupole excitation) or, alternatively, across just one pair of the rods (i.e., a dipole excitation, as depicted in FIG. 9B). The phases of the applied supplemental AC voltage are denoted, in FIG. 9B, as AC0 and AC$\pi$. The frequency of the AC wave should match the secular frequency or frequencies of target ions during the operation. Both amplitudes and frequencies of the waves can be ramped linearly or nonlinearly, e.g. exponentially, to achieve the desired ion manipulation. The ramped frequencies may include, for example, a range of frequencies includes a specific m/z ion secular frequency.

In accordance with other methods in accordance with the present teachings, transducer elements may be "pre-aged" prior to being placed into service within a quadrupole mass spectrometer apparatus. Pre-aging of a transducer entails exposing, possibly selectively, the surface of the transducer to a flux of energetic particles prior to placing the transducer into service. The pre-aging process takes advantage of the general observation that the rate of lessening of the response of a transducer (either an MCP or a scintillator plate) to impact by an energetic particle beam is initially rapid when the transducer is new but, subsequently, decreases towards zero in asymptotic fashion. When incorporated into an imaging ion detector system, such as one of the systems schematically illustrated in FIG. 1C and FIG. 2, the initial rate of decrease of detector response is so great that instrumental calibrations remain valid for only a few days under normal operating conditions. However, factory aging test results (not shown) have indicated that calibrations may be spaced apart by periods of weeks after a pre-aging process. The described pre-aging processes may be employed either instead of or, alternatively, in addition to any of the beam migration or resonant excitation methods described above. Such pre-aging processes may be employed in conjunction with MCP or scintillator components of a known time and position imaging mass spectrometer detector system, such as one of the detector systems illustrated in FIG. 1C and FIG. 2 or other such systems as described in the aforementioned U.S. Pat. No. 8,389,929. Alternatively, the described pre-aging processes may be employed in conjunction with components that are modified according to either one or both of the modifications illustrated in FIG. 6.

Figure 10A:
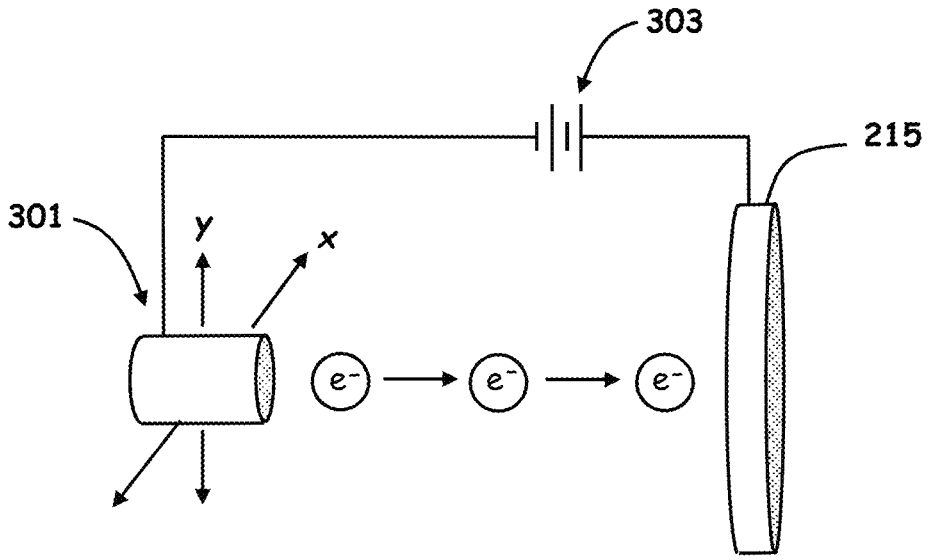
FIG. 10A is a schematic depiction of a method, in accordance with the present teachings, for pre-aging a microchannel plate or a scintillator for use in a mass spectrometer ion imaging detector apparatus.
Figure 10B:
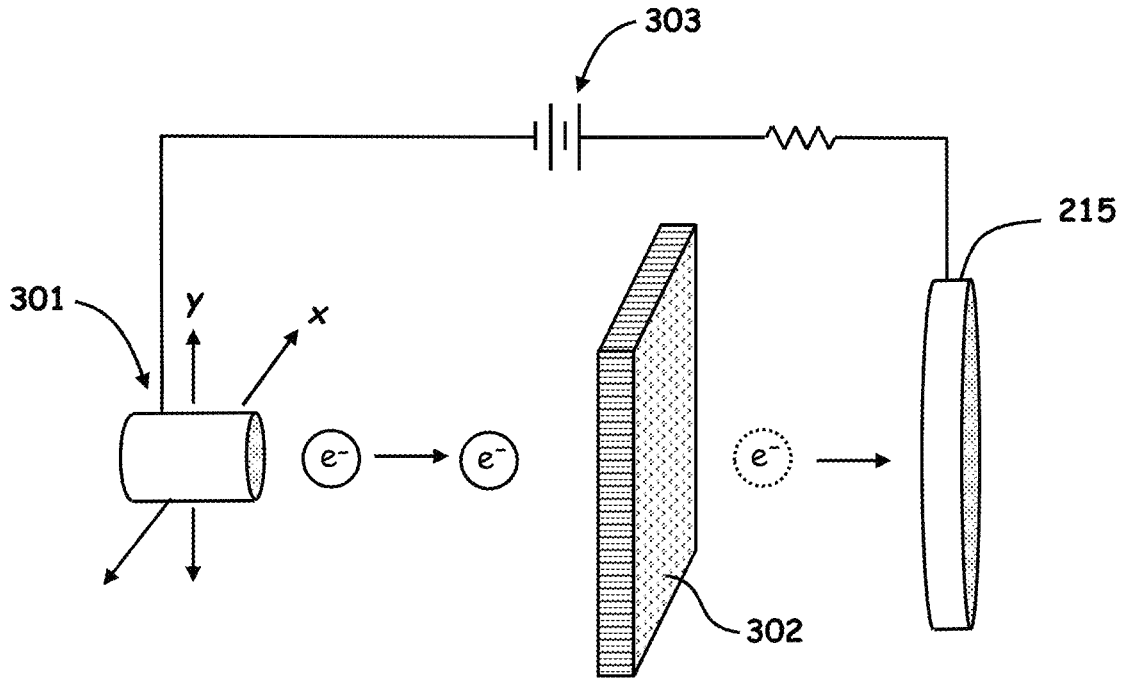
FIG. 10B is a schematic depiction of an alternative method, in accordance with the present teachings, for pre-aging a microchannel plate or a scintillator for use in a mass spectrometer ion imaging detector apparatus.

FIGS. 10A-10B schematically depict the pre-aging process for either an MCP or a scintillator plate 215. In accordance with this process, the transducer element is exposed to a prescribed flux of photons or electrons (all denoted simply as $e^-$) emitted by a LED or an electron emitter 301 where, in the case of electrons, the flux is motivated by an electrical potential difference provided by power supply electrically coupled to the transducer and to the emitter. This exposure of a newly manufactured transducer to photons/electrons causes the initial response diminution to be "burned in" to the transducer prior to its being placed into service. The exposure to the electron flux is made for a prescribed period of time and, optionally, according to a prescribed spatial pattern. Since the cross-sectional area of the electron beam will, in general be smaller than the area of the transducer face on which the electrons are caused to impinge, the electron beam may be progressively scanned or rastered over the surface of the transducer plate by either movement of the electron emitter (as schematically indicated by arrows) or by any other known method, such as programmatically controlled deflection of the beam by a magnetic field.

According to some embodiments, the scanning speed of the electron emitter 301 or the current emitted by the emitter (FIGS. 10A-10B) may be programmatically controlled such that the electron dosage density (number of electrons received per unit area of the transducer) is uniform across the surface of the transducer that is being pre-aged. According to some other embodiments, the scanning speed or emitted current may be programmatically varied as the electron beam is scanned over the transducer surface so that certain pre-determined sections of the surface receive greater or lesser degrees of aging. As an alternative to varying the scanning speed or emitted current, the electron flux may be partially attenuated, in a controlled fashion, by a mask element 302 disposed between the electron emitter 301 and the transducer 215, as illustrated in FIG. 10B. The mask may be constructed so as to non-uniformly attenuate the photon or electron beam, so that the amount of pre-aging (electron dosage density) across the transducer is caused to be non-uniform in accordance with a pre-determined spatial pattern. When the transducer is in operation in an imaging mass spectrometer, the non-uniform pre-aging allows the transducer surface to be more highly sensitive (in a relative sense) to ion current at those locations of the image at which an ion signal is expected to either be less intense or to comprise highly diagnostic information.

FIGS. 11A-11D illustrate four non-limiting examples of pre-aging patterns that might be applied to a transducer 215 that is to be employed in an imaging mass spectrometer. In each of FIGS. 11A-11D, unshaded region 310 represents a portion of the transducer that is not pre-aged and other shaded regions represent pre-aged portions, with the degree of pre-aging represented by the darkness of the shading (i.e., with more shading representing more intense pre-aging). The lines bounding the various regions are provided only to geometrically illustrate the various geometrical patterns and are not intended to necessarily imply the existence of sharp boundaries between regions, in terms of the degree of aging. In fact the degree of aging may be gradational within or between regions.

Figure 11A:
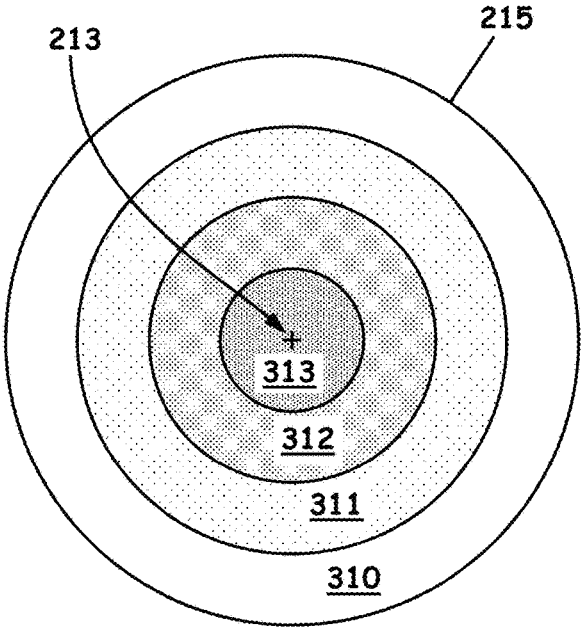
FIG. 11A is a schematic diagram of a first exemplary pre-aging pattern of a micro-channel plate or a scintillator in accordance with the present teachings.
Figure 11B:
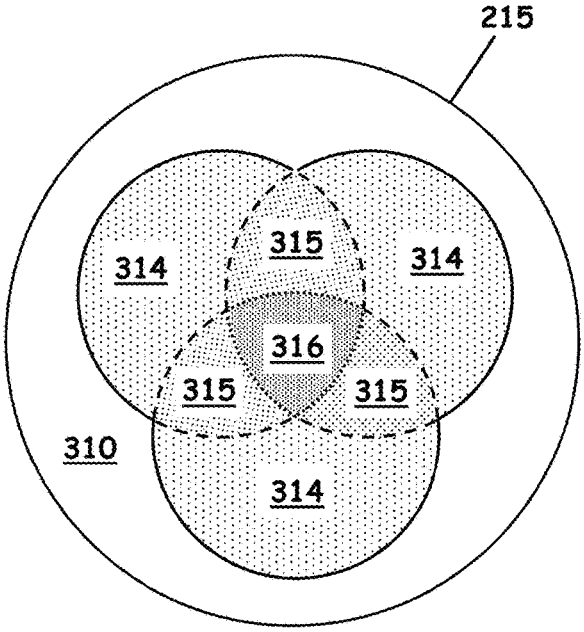
FIG. 11B is a schematic diagram of a second exemplary pre-aging pattern of a micro-channel plate or a scintillator in accordance with the present teachings.
Figure 11C:
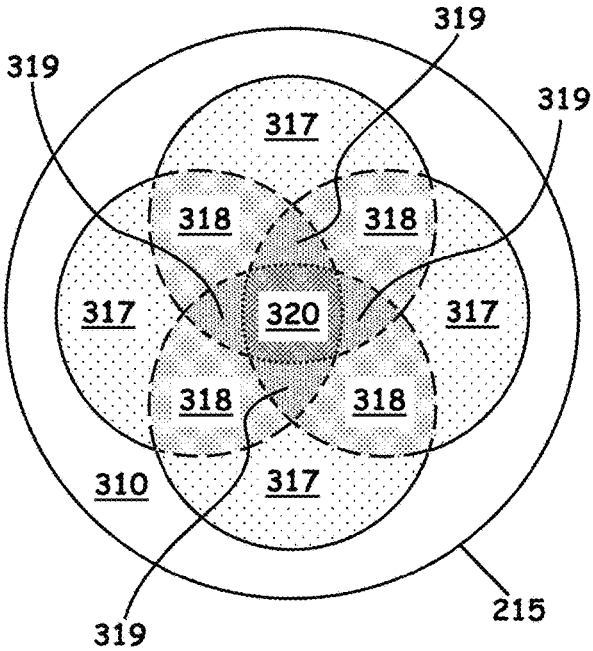
FIG. 11C is a schematic diagram of a third exemplary pre-aging pattern of a micro-channel plate or a scintillator in accordance with the present teachings.

The hypothetical pre-aging patterns illustrated in FIGS. 11A-11C are suitable for use within a mass spectrometer system within which the transducers remain fixed relative to an ion beam emerging from a mass analyzer, with the centers of the transducers disposed along a quadrupole's central longitudinal axis 210 extended. For example, FIG. 11A depicts concentric pre-aging with the most intense pre-aging applied to a zone 313 about the center 213 of the transducer and surrounding by a plurality of concentric annular regions 312, 311 within which the degree of aging progressively decreases outward from the center. This pattern assures that the transducer center, which receives the greatest number of ions emerging from the mass analyzer (i.e., from the zone of ion focusing) is least susceptible to rapid aging while in operation, since this central region comprises the greatest degree of pre-aging. At the same time, regions of the transducer that are displaced from the central region retain greater sensitivity and therefore retain their ability to measure weaker but nonetheless diagnostic ion image patterns away from the zone of ion focusing.

FIG. 11B depicts a different pre-aging pattern that may be produced by directing or aiming an electron beam at or towards each of three separate but partially overlapping regions of a transducer, with each instance of aiming or directing the electron beam causing the electrons to impinge upon a respective circular region of the transducer, as depicted by the three circles that are discernible in FIG. 11B. In addition to the non-pre-aged zone 310, this pattern comprises a single central zone 316 of maximum pre-aging, three separate and distinct zones 314 of minimum pre-aging and three other separate and distinct zones 315 of intermediate pre-aging. Similarly, FIG. 11C depicts a different pre-aging pattern that may be produced by directing or aiming an electron beam at or towards each of four separate but partially overlapping regions of a transducer, with each instance of aiming or directing the electron beam causing the electrons to impinge upon a respective circular region of the transducer. In addition to the non-pre-aged zone 310, this pattern comprises a single central zone 320 of maximum pre-aging, four separate and distinct zones 317 of minimum pre-aging, four other separate and distinct zones 318 of a first level of intermediate pre-aging and four other separate and distinct zones 319 of a second level of intermediate pre-aging that is more intense than that in the zones 318. In operation, a transducer having the pre-aging pattern shown in FIG. 11C is preferably aligned so that its lines of mirror symmetry are aligned, in a predetermined fashion, with planes of mirror symmetry (or approximate mirror symmetry) of a quadrupole with which it is associated. This alignment will generally be effected when the transducer or transducers comprising the pre-aging pattern are installed or re-installed.

Figure 11D:
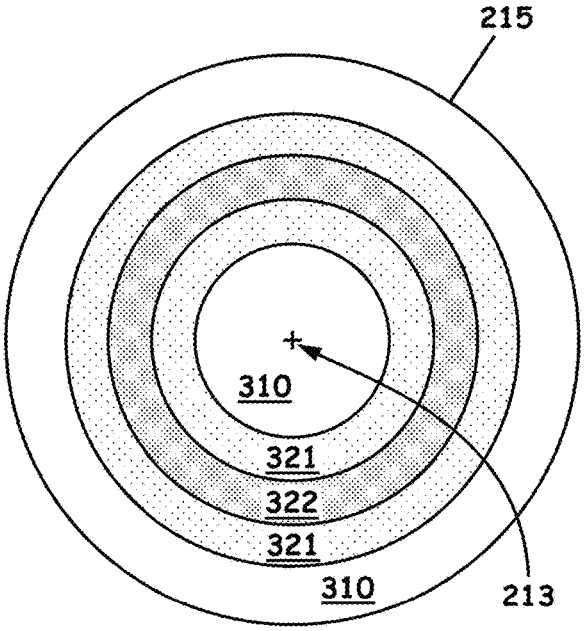
FIG. 11D is a schematic diagram of a fourth exemplary pre-aging pattern of a micro-channel plate or a scintillator in accordance with the present teachings.

FIG. 11D depicts a different pre-aging pattern in which the different zones are geometrically arranged as a set of concentric annular rings, for which the common center is the center 213 of a face of the transducer 215. According to this pattern, the maximum pre-aging occurs within a one of the annular rings 322 and a lesser degree of applied pre-aging occurs within rings 321 both inward and outward of the ring 322 of maximum pre-aging. Also, two non-pre-aged zones are present, a first of which occurs about the center 213 and a second of which occurs about at the periphery of the transducer 215. The number of and widths of the annular rings need not be limited as shown in FIG. 11D. This pre-aging pattern is suitable for use in conjunction with an apparatus in which the zone of ion focusing is caused to migrate in a circular pattern around the center 213 of the transducer (e.g., FIG. 7 and FIG. 8B), either by physical manipulation of the position of the transducer itself or by electrostatic offset of a pseudopotential well within an associated quadrupole.

The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications may fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method of performing mass spectrometric analyses, comprising:

(a) passing a stream of ions through a quadrupole mass analyzer:

(b) intercepting a flux of ions emitted from an exit aperture of the quadrupole mass analyzer at a front face of a stack of multichannel plates and emitting a flux of electrons at a rear face of the stack of multichannel plates in response to the intercepted flux of ions:

(c) intercepting the flux of electrons at a front surface of a scintillator comprising a phosphorescent material and emitting a flux of photons at a rear surface of the scintillator in response to the intercepted flux of ions:

(d) receiving the flux of photons at a photo-detector and converting the flux of photons into a digital signal:

(e) repositioning at least one of the scintillator and the stack of multichannel plates, wherein the repositioning causes a region of ion beam focusing on the front face of the stack of multichannel plates to migrate to a non-aged portion of the front face of the stack of multichannel plates, plates:

(f) intercepting the flux of ions at the front face of the stack of multichannel plates and emitting a second flux of electrons at the rear face of the stack of multichannel plates in response to the intercepted flux of ions:

(g) intercepting the second flux of electrons at the front surface of the scintillator and emitting a second flux of photons at the rear surface of the scintillator in response to the intercepted second flux of ions; and (h) receiving the second flux of photons at the photo-detector and converting the second flux of photons into a second digital signal.

2. A method of performing mass spectrometric analyses as recited in claim 1, wherein the repositioning further causes a region of electron beam focusing on the front surface of the scintillator to migrate to a non-aged portion of the front surface of the scintillator.

3. A method of performing mass spectrometric analyses as recited in claim 1, wherein a movement of the stack of multichannel plates or a movement of the scintillator is in accordance with a pre-defined pattern of movement.

4. A method of performing mass spectrometric analyses as recited in claim 1, wherein the intercepting of the flux of electrons at the front surface of a scintillator comprises intercepting the flux of electrons at the front surface of a single crystal plate of cerium-doped gadolinium aluminum gallium garnet (Ce:GAGG).

5. A method of performing mass spectrometric analyses as recited in claim 1, wherein the intercepting of the flux of electrons at the front surface of a scintillator comprises intercepting the flux of electrons at the front surface of a single crystal plate of cerium-doped yttrium-aluminum garnet (Ce:YAG).

6. A method of performing mass spectrometric analyses as recited in claim 1, wherein the repositioning is performed during execution of one or more of the steps (a) through (d).

7. A method of performing mass spectrometric analyses, comprising:

(a) passing a stream of ions through a quadrupole mass analyzer;

(b) intercepting a flux of ions emitted from an exit aperture of the quadrupole mass analyzer at a front face of a stack of multichannel plates and emitting a flux of electrons in response to the intercepted flux of ions at a rear face of the stack of multichannel plates;

(c) intercepting the flux of electrons at a front surface of a scintillator comprising a phosphorescent material and emitting a flux of photons in response to the intercepted flux of ions at a rear surface of the scintillator;

(d) receiving the flux of photons at a photo-imager; and (e) repositioning at least one of the scintillator and the stack of multichannel plates during the execution of one or more of the steps (a) through (d), wherein the repositioning causes a region of ion beam focusing on the front face of the stack of multichannel plates to migrate to a non-aged portion of the front face of the stack of multichannel plates.

8. A method of performing mass spectrometric analyses as recited in claim 7, wherein the intercepting of the flux of electrons at the front surface of a scintillator comprises intercepting the flux of electrons at the front surface of a single crystal plate of cerium-doped gadolinium aluminum gallium garnet (Ce:GAGG).

9. A method of performing mass spectrometric analyses as recited in claim 7, wherein the intercepting of the flux of electrons at the front surface of a scintillator comprises intercepting the flux of electrons at the front surface of a single crystal plate of cerium-doped yttrium-aluminum garnet (Ce:YAG).

10. A method of performing mass spectrometric analyses as recited in claim 7, wherein the repositioning further causes a region of electron beam focusing on the front surface of the scintillator to migrate to a non-aged portion of the front surface of the scintillator.

11. A method of performing mass spectrometric analyses as recited in claim 7, wherein the repositioning is performed during execution of one or more of the steps (a) through (d).

* * * * *